US008557491B2

(12) United States Patent
Sugimoto et al.

(10) Patent No.: US 8,557,491 B2
(45) **Date of Patent: *Oct. 15, 2013**

(54) TONER, DEVELOPER, TONER CONTAINER, PROCESS CARTRIDGE, AND IMAGE FORMING METHOD

(75) Inventors: Tsuyoshi Sugimoto, Mishima (JP); Naohito Shimota, Numazu (JP); Hiroshi Yamashita, Numazu (JP); Naohiro Watanabe, Shizuoka (JP); Shinichi Wakamatsu, Numazu (JP); Masaki Watanabe, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 724 days.

This patent is subject to a terminal disclaimer.

(21) Appl. No.: 12/509,923

(22) Filed: Jul. 27, 2009

(65) Prior Publication Data

US 2010/0035170 A1 Feb. 11, 2010

(30) Foreign Application Priority Data

Aug. 5, 2008 (JP) ..... 2008-202015

(51) Int. Cl.
*G03G 9/08* (2006.01)

(52) U.S. Cl.
USPC ..... 430/108.4; 430/108.1; 430/109.4

(58) Field of Classification Search
USPC ..... 430/108.1, 180.4, 109.4
See application file for complete search history.

(56) References Cited

U.S. PATENT DOCUMENTS 5,368,972 A 11/1994 Yamashita et al.
6,140,000 A 10/2000 Yamashita
6,329,115 B1 12/2001 Yamashita
6,335,134 B1 * 1/2002 Hagi et al. ..... 430/108.1
6,360,068 B1 3/2002 Kinoshita et al.
6,403,275 B1 6/2002 Kuramoto et al.
6,416,914 B1 7/2002 Nakamura et al.
6,432,589 B1 8/2002 Uchinokjura et al.
6,503,676 B2 1/2003 Yamashita et al.
6,660,443 B2 12/2003 Sugiyama et al.
6,682,866 B2 1/2004 Sugiyama et al.
6,740,460 B2 5/2004 Tomita et al.
6,756,175 B2 6/2004 Emoto et al.
6,757,507 B2 6/2004 Machizuki et al.
6,787,280 B2 9/2004 Yamashita et al.
6,824,945 B2 11/2004 Emoto et al.

(Continued)

FOREIGN PATENT DOCUMENTS

JP 4-70765 3/1992
JP 2000-314987 * 11/2000 ..... G03G 9/08
JP 2004-245854 9/2004
JP 2006-208609 8/2006

OTHER PUBLICATIONS

Machine English language translation of JP 2000-314987, Nov. 2000.*

*Primary Examiner* — Hoa V Le

(74) *Attorney, Agent, or Firm* — Oblon, Spivak, McClelland, Maier & Neustadt, L.L.P.

(57) ABSTRACT

A toner according to the present invention contains at least a polyester resin as a binder resin, a colorant, a releasing agent, a fixing-assisting component, and a fatty acid, wherein the fixing-assisting component has a melting point of 60° C. to 120° C. and contains at least one of an esterified compound obtained by esterification of the fatty acid and an amide compound obtained by amidation of the fatty acid.

10 Claims, 4 Drawing Sheets

(56) References Cited

U.S. PATENT DOCUMENTS 6,846,604 B2 1/2005 Emoto et al.
6,849,369 B2 2/2005 Yagi et al.
6,852,462 B2 2/2005 Emoto et al.
6,855,468 B1 2/2005 Yamamoto et al.
6,887,636 B2 5/2005 Matsuda et al.
6,898,406 B2 5/2005 Suzuki et al.
6,902,857 B2 6/2005 Yagi et al.
6,924,073 B2 8/2005 Higuchi et al.
6,936,390 B2 8/2005 Nanya et al.
6,946,229 B2 9/2005 Suzuki et al.
6,947,692 B2 9/2005 Kondo et al.
7,005,223 B2 2/2006 Yamashita
7,056,635 B2 6/2006 Tanaka et al.
7,056,636 B2 6/2006 Tomita et al.
7,056,638 B1 6/2006 Tomita et al.
7,074,535 B2 7/2006 Saito et al.
7,074,541 B2 7/2006 Yamashita et al.
7,083,890 B2 8/2006 Emoto et al.
7,129,013 B2 10/2006 Higuchi et al.
7,157,199 B2 1/2007 Emoto et al.
7,157,201 B2 1/2007 Tomita et al.
7,163,775 B2 1/2007 Takada et al.
7,208,256 B2 4/2007 Tanaka et al.
7,241,545 B2 7/2007 Nanya et al.
7,241,548 B2 7/2007 Sugiyama et al.
7,303,847 B2 12/2007 Tomita et al.
7,306,887 B2 12/2007 Tanaka et al.
7,348,117 B2 3/2008 Inoue et al.
7,354,690 B2 4/2008 Ishii et al.
7,374,848 B2 5/2008 Matsuoka et al.
7,374,851 B2 5/2008 Nakayama et al.
7,384,722 B2 6/2008 Ohtani et al.
7,396,627 B2 7/2008 Watanabe et al.
7,429,442 B2 9/2008 Honda et al.
7,435,521 B2 10/2008 Yagi et al.
7,437,111 B2 10/2008 Yamada et al.
7,449,273 B2 11/2008 Ohki et al.
7,455,942 B2 11/2008 Nagatomo et al.
7,459,255 B2 12/2008 Tanaka et al.
7,473,508 B2 1/2009 Higuchi et al.
7,488,564 B2 2/2009 Tanaka et al.
7,504,188 B2 3/2009 Yamada et al.
7,531,279 B2 5/2009 Watanabe et al.
7,541,128 B2 6/2009 Watanabe et al.
7,550,245 B2 6/2009 Inoue et al.
7,560,216 B2 7/2009 Sugiyama et al.
2002/0039698 A1 4/2002 Sasaki et al.
2003/0027066 A1 2/2003 Yamashita et al.
2003/0055159 A1 3/2003 Yamashita et al.
2003/0096185 A1 5/2003 Yamashita et al.
2003/0219669 A1 11/2003 Yamashita et al.
2004/0115551 A1 6/2004 Sugiyama et al.
2004/0197117 A1* 10/2004 Masuda et al. ..... 399/258
2005/0079433 A1 4/2005 Watanabe et al.
2005/0112488 A1 5/2005 Yamada et al.
2005/0164112 A1 7/2005 Ohki et al.
2005/0196691 A1 9/2005 Ohtani et al.
2005/0277041 A1* 12/2005 Lee et al. ..... 430/108.6
2005/0277045 A1 12/2005 Saito et al.
2006/0024097 A1 2/2006 Yamada et al.
2006/0057488 A1 3/2006 Inoue et al.
2006/0068312 A1 3/2006 Yamashita et al.
2006/0177756 A1 8/2006 Sugimoto et al.
2006/0210903 A1 9/2006 Ohki et al.
2007/0015077 A1 1/2007 Yamashita et al.
2007/0054210 A1 3/2007 Ohki et al.
2007/0059626 A1 3/2007 Inoue et al.
2007/0141500 A1 6/2007 Sugimoto et al.
2007/0218380 A1 9/2007 Uchinokura et al.
2007/0218381 A1 9/2007 Uchinokura et al.
2007/0218382 A1 9/2007 Emoto et al.
2007/0218386 A1 9/2007 Suzuki et al.
2007/0218392 A1 9/2007 Yamada et al.
2007/0275315 A1 11/2007 Nagatomo et al.
2008/0069606 A1 3/2008 Yamashita et al.
2008/0069616 A1 3/2008 Kojima et al.
2008/0070144 A1 3/2008 Nagatomo et al.
2008/0070151 A1 3/2008 Sugimoto et al.
2008/0085460 A1* 4/2008 Ninomiya et al. ..... 430/109.4
2008/0096116 A1* 4/2008 Utsumi et al. ..... 430/48
2008/0227002 A1 9/2008 Moriya et al.
2008/0233496 A1 9/2008 Kotsugai et al.
2008/0233505 A1 9/2008 Nagatomo et al.
2008/0280218 A1 11/2008 Sabu et al.
2008/0280219 A1 11/2008 Nakayama et al.
2008/0292985 A1 11/2008 Suzuki et al.
2008/0318144 A1 12/2008 Watanabe et al.
2008/0318148 A1 12/2008 Sugimoto et al.
2009/0003885 A1 1/2009 Sabu et al.
2009/0074467 A1 3/2009 Seshita et al.
2009/0092917 A1 4/2009 Sugimoto et al.
2009/0104555 A1 4/2009 Wakamatsu et al.
2009/0142680 A1 6/2009 Shimota et al.
2009/0155709 A1 6/2009 Watanabe et al.
2009/0214973 A1 8/2009 Sugimoto et al.

* cited by examiner

TONER, DEVELOPER, TONER CONTAINER, PROCESS CARTRIDGE, AND IMAGE FORMING METHOD

BACKGROUND OF THE INVENTION

1. Field of the Invention

The present invention relates to a toner for developing latent electrostatic images in electrophotography, electrostatic recording, electrostatic printing or the like and also relates to a developer, a toner container, a process cartridge and an image forming method each using the toner.

2. Description of the Related Art

Generally, image formation by electrophotography, electrostatic recording, electrostatic printing etc. is performed by a series of processes in which a latent electrostatic image is formed on a latent electrostatic image bearing member (hereinafter, otherwise referred to as "photoconductor" or "electrophotographic photoconductor"), the latent electrostatic image is developed using a developer to form a visible image (toner image), the visible image is transferred onto a recording medium such as paper, and then fixed to form a fixed image on the recording medium.

As the developer, there are two types of developers, i.e. a one-component developer singularly using a magnetic toner or a non-magnetic toner, and a two-component developer composed of a toner and a carrier.

As a fixing method used in electrophotography, heat roller methods are widely and generally used in terms of increased energy efficiency, in which a heat roller is directly press-contacted with a toner image on a recording medium. The heat roller methods require a large amount of electric power for fixing. So, for the purpose of saving energy, a variety of studies have been done in an attempt to reduce electric power consumption of heat rollers. For instance, a method is generally and often used, in which at the time when it is not intended to form an image, the output power of a heater for heating the heat roller used is reduced, and at the time of outputting an image, the output power of the heater is increased to thereby increase the temperature of the heat roller.

In this case, however, in order to increase the temperature of the heat roller to a temperature necessary for fixing, from the temperature at sleep time, a standby time period of about several tens seconds is necessary, and users can be stressed from the standby time period. Alternatively, when it is not intended to form an image, it is desired to reduce the power consumption by fully turning off the heater. To achieve these demands, it is necessary to lower the fixing temperature of toner itself to decrease the fixing temperature of toner in available time.

With the development of electrophotographic technology, toner used in the developer is required to have excellent low-temperature fixability and storage stability (blocking resistance), and there have been a variety of attempts to use polyester resins which have higher affinity with recording media and the like and have more excellent low-temperature fixability than styrene resins which had been generally used as toner binder resins. For example, there have been proposed a toner containing a linear polyester resin whose physical properties, such as molecular weight, are specified (see Japanese Patent Application Laid-Open (JP-A) No. 2004-245854), a toner containing a non-linear crosslinkable 20 polyester resin using rosins as acid components (see Japanese Patent Application Laid-Open (JP-A) No. 4-70765, and the like.

In order to achieve further high-speed operation performance and energy saving in image forming apparatuses, conventionally used toner binder resins still leave a lot to be desired in terms of responding to market demands, and it is difficult to maintain sufficient fixing strength of toner by shortening the fixing time in a fixing step and/or lowering the heating temperature of a fixing unit.

A toner containing a polyester resin using rosins as i described in JP-A No. 4-70765 is superior in the low-temperature fixability as well as the pulverizability, and thus the toner is advantageous in improving the toner productivity by a pulverization method. Also, use of 1,2-propanediol, which is a branched-chain alcohol having 3 carbon atoms, as an alcohol component makes it possible to improve the low-temperature fixability while maintaining the offset resistance, as compared to use of alcohol having 2 or less carbon atoms, and is effective in preventing degradation of the storage stability accompanied by a reduction in glass transition temperature, as compared to a branched alcohol having 4 or more carbon atoms. The use of such a polyester resin as a toner binder resin makes it possible to provide such an effect that an image can be fixed at a low-temperature and the storage stability can be improved.

The demand for energy saving tends to be more and more increased, and the low-temperature fixability of toner has become more improved than before, by using polyester resins excellent in low-temperature fixability, however, it will be difficult in the near future to satisfactorily respond to the demand for energy saving by just using polyester resins.

In recent years, attempts have been made to improve the low-temperature fixability of toner by incorporation of a fixing-assisting component to the toner (see Japanese Patent Application Laid-Open (JP-A) No. 2006-208609). JP-A No. 2006-208609 proposes a toner which satisfies both heat-resistant storage stability and low-temperature fixability by allowing a fixing-assisting component to exist as crystal domains in the toner. With higher speed operation performance in recent years, it will be desired to satisfy the demands for high-durability and further energy saving of toner, and accordingly, further improvements and developments are still desired.

BRIEF SUMMARY OF THE INVENTION

The present invention aims to solve the various problems in related art and to achieve the following object. That is to say, the object of the present invention is to provide a toner which is excellent in low-temperature fixability and offset-resistance and which is capable of forming high-quality images with high-image sharpness over a long period of time without contaminating the fixing device and formed images, and also provide a developer, a toner container, a process cartridge and an image forming method each using the toner.

As a result of carrying out extensive studies and examinations in an attempt to solve the aforesaid problems, the present inventors have found that in a toner which contains at least a polyester resin as a binder resin, a colorant, a releasing agent, a fixing-assisting component having a melting point of 60° C. to 120° C. and a fatty acid, by incorporation of at least one of an esterified compound obtained by esterification of the fatty acid and an amide compound obtained by amidation of the fatty acid as fixing-assisting component, the low-temperature fixability of the toner can be further improved.

The present invention has been made based on the findings of the present inventors. Means for solvent the aforesaid problems are as follows:

<1> A toner including at least a polyester resin as a binder resin, a colorant, a releasing agent, a fixing-assisting component, and a fatty acid, wherein the fixing-assisting component has a melting point of 60° C. to 120° C. and contains at least one of an esterified compound obtained by esterification of the fatty acid and an amide compound obtained by amidation of the fatty acid.

<2> The toner according to <1>, wherein the amide compound has a melting point of 70° C. to 120° C. and is a fatty acid amide compound having one of an amino group and a hydroxyl group at the end of its molecular chain.

<3> The toner according to one of <1> and <2>, wherein the esterified compound is obtained by reaction of a fatty acid containing at least one of a stearic acid and a behenic acid in an amount of 80% by mass or more, with an alcohol containing ethylene glycol in an amount of 80% by mass or more; and the esterified compound has a hydroxyl value of 10 mgKOH/g to 100 mgKOH/g.

<4> The toner according to any one of <1> to <3>, wherein the amount of the fatty acid contained in the toner is 0.5% by mass to 5.0% by mass relative to the total amount of the toner <5> The toner according to any one of <1> to <4>, wherein the amount of the fixing-assisting component contained in the toner is 3% by mass to 20% by mass relative to the total amount of the toner.

<6> The toner according to any one of <1> to <5>, wherein at least one polyester resin has an acid value of 5 mgKOH/g to 40 mgKOH/g.

<7> The toner according to any one of <1> to <6>, wherein at least one polyester resin has a hydroxyl value of 5 mgKOH/g to 100 mgKOH/g.

<8> The toner according to any one of <1> to <7>, wherein at least one polyester resin has a glass transition temperature Tg of 55° C. to 80° C.

<9> The toner according to any one of <1> to <8>, produced in an aqueous medium.

<10> A developer including at least the toner according to any one of <1> to <9>.

<11> A toner container in which the toner according to any one of <1> to <9> is contained.

<12> A process cartridge, detachably mounted to a main body of an image forming apparatus, the process cartridge including at least a latent electrostatic image bearing member, and a developing unit configured to develop a latent electrostatic image formed on the latent electrostatic image bearing member using a toner to form a visible image, wherein the toner is the toner according to any one of <1> to <9>.

<13> An image forming method including at least: forming a latent electrostatic image on a surface of a latent electrostatic image bearing member; developing the latent electrostatic image using a toner to form a visible image; transferring the visible image onto a recording medium; and fixing the transferred image on the recording medium, wherein the toner is the toner according to any one of <1> to <9>.

According to the present invention, it is possible to solve the aforesaid problems and to provide a toner which is excellent in low-temperature fixability and offset resistance and which is capable of forming high-quality images with high-image sharpness over a long period of time without contaminating the fixing device and formed images, and provide a developer, a toner container, a process cartridge and an image forming method each using the toner.

DETAILED DESCRIPTION OF THE INVENTION (Toner)

Figure 1:
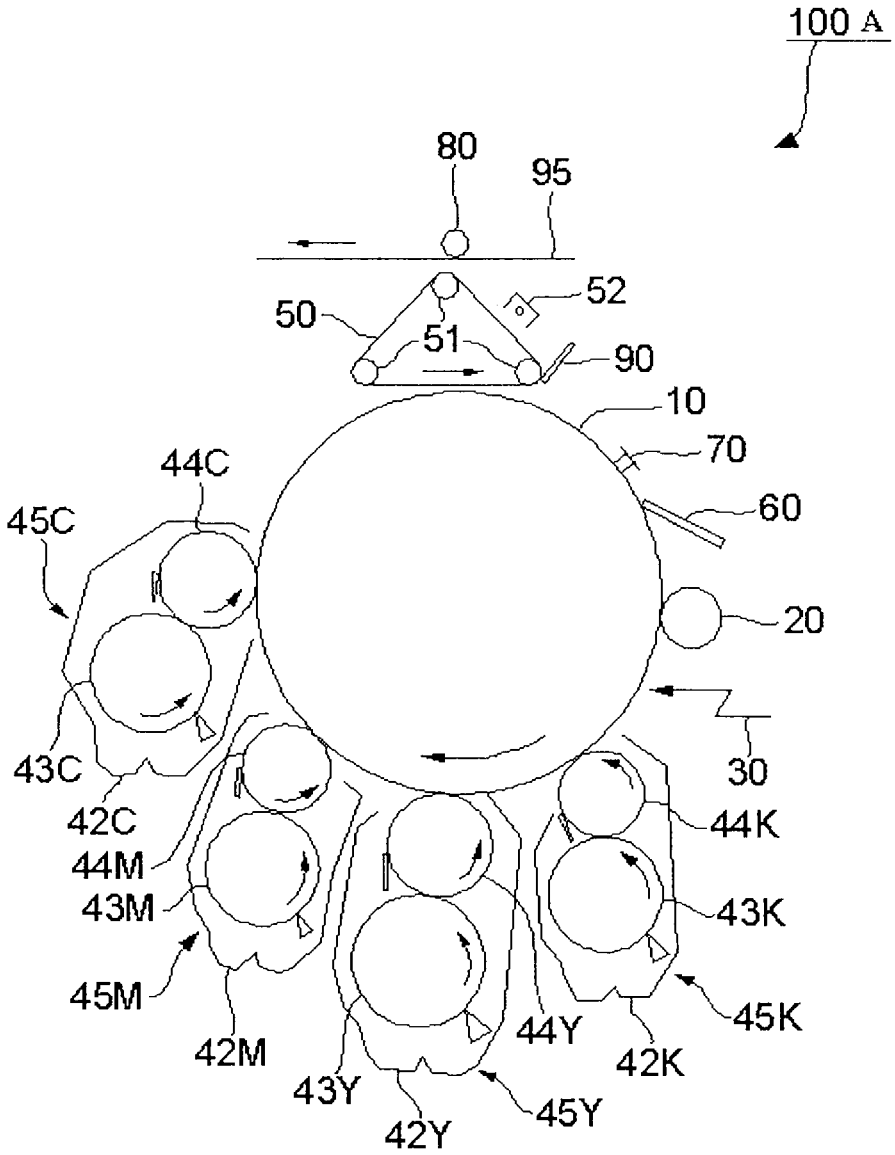
FIG. 1 is a diagram showing one example of an image forming apparatus according to the present invention.

A toner of the present invention contains at least a polyester resin as a binder resin, a colorant, a releasing agent, a fixing-assisting component and a fatty acid and further contains other components in accordance with the necessity.

<Fatty Acid>

The fatty acid is composed of at least one fatty acid and constitutes the fixing-assisting component. In other words, the fixing-assisting component is composed of at least one of an esterified compound obtained by esterification of the fatty acid and an amide compound obtained by amidation of the fatty acid.

The fatty acid can be suitably selected in accordance with the intended use. Examples thereof include lauric acid, palmitic acid, stearic acid, arachidic acid, eicosanoic acid, behenic acid, and lignoceric acid.

The amount of the fatty acid contained in the toner is not particularly limited and may be suitably adjusted in accordance with the intended use, however, it is preferably 0.5% by mass to 5.0% by mass to the total amount of toner. When the amount of the fatty acid is less than 0.5% by mass to the total amount of toner, sufficient low-temperature fixability may not be obtained. When the amount is more than 5.0% by mass, the heat resistant storage stability of the resulting toner may degrade.

The incorporation of at least one fatty acid constituting the fixing-assisting component into the toner makes it possible for the fixing-assisting component to be quickly soluble with the binder resin when heated in the fixing process to soften the binder resin and makes it possible for the toner to have excellent low-temperature fixability, because the fatty acid serves to disperse the fixing-assisting component more uniformly and finely in toner. Fatty acids other than the component constituting the fixing-assisting component have less improved effect in acceleration of softening of the fixing-assisting component to the resin and in dispersibility of the fixing-assisting component in the toner, and thus it is impossible to obtain sufficient low-temperature fixability.

Also, the addition of the fatty acid constituting the fixing-assisting component into the toner makes it possible for the fixing-assisting component in the toner to be uniformly and finely dispersed for each of the toner particles. Therefore, it is possible to obtain a toner which is excellent in transferability over a long period of time and causes less image fogging and toner filming.

<Fixing-Assisting Component>

The fixing-assisting component has a melting point of 60° C. to 120° C. and contains at least one of an esterified compound and an amide compound. A fixing-assisting component having such a composition is superior in solubility with a polyester resin excellent in low-temperature fixability and can further improve the low-temperature fixability.

—Amide Compound—

The amide compound is obtained by amidation of a fatty acid. Among such amide compounds, a fatty acid amide compound which has a melting point of 70° C. to 120° C. and which has one of an amino group and a hydroxyl group at the end of its molecular chain is preferable.

Since the fatty acid amide compound has at least one of an amino group (—$NH_2$) and a hydroxyl group (—OH) each having a high polarity at the end of the fatty acid molecule, the compound is excellent in solubility with resins which are the main component of the toner and can be quickly dissolved by being heated in the fixing process to quickly soften the binder resin, thereby making it possible to improve the low-temperature fixability of the toner.

Examples of the fatty acid amide compound are monoamide compounds; fatty acid amide alcohol adducts such as an amide compound of mono-alcohol adduct type and an amide compound of bis-alcohol adduct type. Among these, a monoamide compound is preferable in terms that it is superior in solubility with resins, capable of improving the low-temperature fixability of toner and does not impair the heat resistant storage stability of toner.

—Monoamide Compound—

The monoamide compound is represented by the following structural formula (1):

$$R1\text{-}CONH_2 \quad (1)$$

In the structural formula (1), R1 is a saturated or monovalent to divalent unsaturated hydrocarbon group having 10 to 30 carbon atoms.

—Amide Compound of Mono-Alcohol Adduct Type—

The amide compound of mono-alcohol adduct type is represented by the following structural formula (2):

Examples of the amide compound of mono-alcohol adduct type are alcohol adducts of monoamide compound.

$$R1\text{-}NHCO\text{—}R2\text{-}OH \quad (2)$$

In the structural formula (2), R1 is a saturated or monovalent to divalent unsaturated hydrocarbon group having 10 to 30 carbon atoms, and R2 is a saturated or monovalent to divalent unsaturated hydrocarbon group having 1 to 30 carbon atoms.

—Amide Compound of Bis-Alcohol Adduct Type—

The amide compound of bis-alcohol adduct type is represented by the following structural formula (3).

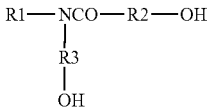

(3)

In the structural formula (3), R1 is a saturated or monovalent to divalent unsaturated hydrocarbon group having 10 to 30 carbon atoms, R2 is a saturated or monovalent to divalent unsaturated hydrocarbon group having 1 to 30 carbon atoms, and R3 is a saturated or monovalent to divalent unsaturated hydrocarbon group having 1 to 30 carbon atoms.

The melting point of the fatty acid amide compound is 70° C. to 120° C., however, it is preferably 75° C. to 100° C., and more preferably 75° C. to 95° C. When the melting point is lower than 70° C., the heat resistant storage stability of the toner may degrade. When the melting point is higher than 120° C., the toner may not obtain sufficient low-temperature fixability.

The monoamide compound having a melting point of 70° C. to 120° C. is not particularly limited and may be suitably selected in accordance with the intended use. Examples thereof include a monoamide compound obtained by amidation of a saturated or monovalent unsaturated fatty acid having 10 to 30 carbon atoms such as palmitic acid amide, palmioleic acid amide, stearic acid amide, oleic acid amide, arachidic acid amide, eicosanoic acid amide, behenic acid amide, erucic acid amide, and lignoceric acid amide.

—Esterified Compound—

The esterified compound is obtained by esterification of a fatty acid. Among such esterified compounds, an esterified compound obtained by reaction of a fatty acid containing at least one of a stearic acid and a behenic acid in an amount of 80% by mass or more with an alcohol containing ethylene glycol in an amount of 80% by mass or more. Since the esterified compound has a melting point of 60° C. to 85° C., is excellent in solubility with polyester resins and capable of quickly softening binder resins, it can further improve the low-temperature fixability of the polyester resin.

Also, as the fatty acid, use of a steric acid and a behenic acid as the main components makes it possible to improve the crystallinity of the esterified compound, thereby obtaining an esterified compound having excellent sharp-melt property. For this reason, the esterified compound can be quickly dissolved by being heated in the fixing process to quickly soften the binder resin, thereby making it possible for the resulting toner to exhibit low-temperature fixability.

As the fatty acid, a single substance having 12 to 24 carbon atoms or a mixture of the single substances can also be used, besides the steric acid and behenic acid as the main components. Specific examples thereof include single substances of lauric acid, palmitic acid, arachidic acid, eicosanoic acid, and lignoceric acid, or mixtures thereof. When the number of carbon atoms of the single substance is less than 12, the melting point of the esterified compound itself lowers due to degradation of the crystallinity, which may lead to incapability of obtaining sufficient heat resistant storage stability. Also, the fixing-assisting component loses its sharp melt property, which may lead to incapability of obtaining a sufficient low-temperature fixing effect.

Since the alcohol component contains ethylene glycol as the main component, the esterified compound becomes excellent in sharp melt property. And so, the esterified compound can be quickly dissolved by being heated in the fixing process to quickly soften the binder resin, thereby making it possible for the resulting toner to exhibit low-temperature fixability.

As the alcohol component, besides the ethylene glycol as the main component, it is possible to use a single substance of polyol such as ethylene glycol, propylene glycol, butylene glycol, tetramethylene glycol and glycerin, or a polycondensate obtained by polycondensation of the polyol, as necessary. When the polycondensate is used as the alcohol component, the polymerization degree is preferably 2 to 20. When the polymerization degree is higher than 20, the fixing-assisting component loses its sharp melt property due to degradation of the crystallinity, which may lead to incapability of sufficiently improving the low-temperature fixing effect.

The esterified compound can achieve the low-temperature fixing effect by softening the polyester resin as the main component of the toner. For this reason, it is desired that the esterified compound have a hydroxyl value.

The hydroxyl value of the esterified compound is adjusted to 10 mgKOH/g to 100 mgKOH/g. When the hydroxyl value is less than 10 mgKOH/g, it is impossible to improve the low-temperature fixing effect due to the insufficient solubility to the polyester resin. In contrast, when the hydroxyl value is more than 100 mgKOH/g, the chargeability of the resulting toner may degrade under high-temperature and high humidity conditions.

Note that the hydroxyl value is an amount [mg] of a potassium hydroxide (KOH) required for neutralizing an acetic acid bonded to a hydroxyl group when 1 g of a sample is acetylated under the following conditions. The following describes how the hydroxyl value is measured and determined.

Firstly, about 1 g of a sample is precisely weighed and put in a round flask, 5 mL of an acetic anhydride/pyridine test solution is accurately weighed and poured into the flask, a small funnel is placed over the flask aperture, and the bottom of the flask is dipped in an oil bath at 95° C. to 100° C., in a depth of about 1 cm and heated for 1 hour. Subsequently, the flask is cooled, 1 mL of water is added thereto, and the flask is shaken vigorously and further heated for 10 minutes. After further cooling the flask, the small funnel and the neck of the flask are washed with 5 mL of ethanol. Next, 1 mL of a phenol phthalein test solution is added as an indicator to the flask, and then an overdose of acetic acid is titrated with 0.5 mol/L of an ethanol/potassium hydroxide solution (main test).

A blank test is carried out in the same manner as described above, except that no sample is put into the flask. The hydroxyl value is determined by the following equation.

$$\text{Hydroxyl value}=[(a\ [\text{mL}]-b\ [\text{mL}])\times 28.05]/\text{sampled amount of sample [g]}+\text{acid value}$$

In the above equation, "a" and "b" represent a titration amount of 0.5 mol/L of the ethanol/potassium hydroxide solution employed in the main test and the blank test, respectively.

The acid value is an amount [mg] of a potassium hydroxide (KOH) required for neutralizing 1 g of a sample. The following describes how the acid value is measured and determined.

Firstly, 1.0 g of a sample is precisely weighed, 50 mL of an ethanol/ether mixture liquid (volume ratio: 1:1) is added to the sample, and the sample is heated as necessary to be dissolved to obtain a test liquid. Next, after cooling the test liquid, a few drops of a phenol phthalein test solution are added to the test liquid, and the resulting test liquid is titrated with 0.1 mol/L ethanol/potassium hydroxide solution until it shows a red color for continuous 30 seconds. The acid value is determined by the following equation.

$$\text{Acid value}=c\ [\text{mL}]\times 5.611/\text{sampled amount of sample [g]}$$

In the above equation, "c" represents a titration amount of 0.1 mol/L of the ethanol/potassium hydroxide solution.

The melting point of the esterified compound in the present invention is 60° C. to 85° C. When the melting point is lower than 60° C., the heat resistant storage stability of the resulting toner degrades, and when higher than 85° C., the low-temperature fixability of the toner degrades. Note that the melting point is a temperature at which maximum heat absorption appears in a differential thermal curve obtained by DSC (Differential Scanning Calorimetry).

The fixing-assisting component exists as crystal domains in the toner and has a characteristic of being soluble with the resin when heated.

The fixing-assisting component exists as crystal domains which are independent of the binder resin in the toner before the toner receives heat from the fixing unit, but is quickly fused by heat at the time of fixing and is soluble with the binder resin to accelerate the softening of the binder resin.

Since the fixing-assisting component does not soften the binder resin before the toner is fixed, the toner of the present invention is superior in heat resistant storage stability. Further, since the fixing-assisting component has an effect of softening the binder resin at the time of fixing, the toner of the present invention is superior in low-temperature fixability.

As a method of confirming whether the fixing-assisting component has crystallinity before fixed, for example, a method of measuring a retention state of crystallinity (soluble or insoluble fraction) from an X-ray diffraction chart.

More specifically, whether the fixing-assisting component has crystallinity in the toner can be confirmed by using an X-ray crystal diffraction spectrometer (X' Pert MRDX' Pert MRD, manufactured by Philips Corp.). Firstly, a single substance of fixing-assisting component is crushed by a mortar to produce a sample powder, and the thus obtained sample powder is uniformly applied onto a sample holder. Subsequently, the sample holder is set inside the diffraction spectrometer to subject it to a measurement and to obtain a diffraction spectrum of the fixing-assisting component. Next, a toner powder is applied onto a holder to subject it to a measurement, similarly. The fixing-assisting component contained in the toner can be identified by using of the diffraction spectrum obtained beforehand. Also, an accessory heating unit is attached to the diffraction spectrometer, and variations in diffraction spectrum when varying the temperature can be measured. The change in peak area of X-ray diffraction spectra derived from the fixing-assisting component at normal temperature and at 150° C. is measured using the heating unit, thereby making it possible to determine the ratio between soluble fraction and insoluble fraction of the fixing-assisting component with respect to the resin before and after heating the fixing-assisting component. The greater the rate of change in peak area derived from the fixing-assisting component before and after the heating treatment, which means the more the solubilization of the fixing-assisting component with the toner resin through heating at the time of fixing advances. The toner has an increased rate of change in peak area derived from the fixing-assisting component after the heating treatment by incorporation of the fixing-assisting component, and thus it can be said that the toner is excellent in low-temperature fixability.

The dispersion diameter of the fixing-assisting component is not particularly limited and may be suitably selected in accordance with the intended use, however, it is preferably, as a particle size in a direction of maximum size, 10 nm to 3 μm, and more preferably 50 nm to 1 μm.

When the dispersion diameter is smaller than 10 nm, the contact surface area between the fixing-assisting component and the binder resin is substantially increased, possibly leading to degradation of the heat resistant storage stability of the toner. When the dispersion diameter is larger than 3 μm, the solubilization with the binder resin cannot sufficiently advance at when the component is heated at the fixing, possibly leading to degradation of the low-temperature fixability.

The dispersion diameter of the fixing-assisting component can be measured by, for example, the following method. A toner is embedded in an epoxy resin, sliced into an about 100 nm ultra-thin section and then dyed with ruthenium tetroxide. The ultra-thin section is observed by a transmission electron microscope (TEM) with magnification of ×10,000 and photographed, and the obtained photograph image is observed and evaluated for the dispersion state of the fixing-assisting component, thereby measuring the dispersion diameter. In order to identify the fixing-assisting component from the releasing agent in the toner, it is necessary that both the fixing-assisting component and the releasing agent be dyed with ruthenium tetroxide and respective sections thereof be observed by a transmission electron microscope in a similar manner to the above to determine the difference in contrast between the fixing-assisting component and the releasing agent, whereby the fixing-assisting component can be identified from the releasing agent in the toner.

In the present invention, when the glass transition temperature of the polyester resin is represented by Tgr, and the glass transition temperature of the polyester resin after adding 10 parts by mass of the fixing-assisting component to 90 parts by mass of the polyester resin and heating the mixture at 150° C. is represented by Tgr', ΔTg which is a difference in glass transition temperature preferably satisfies the equation, ΔTg=Tgr−Tgr'>10° C., and more preferably satisfies the equation, ΔTg=Tgr−Tgr'>15° C.

Note that when two types of polyester resins are contained in the toner, at least one polyester resin is allowed to satisfy the requirement described above.

Here, the glass transition temperature (Tgr) of the polyester resin and the glass transition temperature (Tgr') of the polyester resin after addition of 10 parts by mass of the fixing-assisting component thereto can be measured by means of, for example, a DSC system (differential scanning calorimeter) (DSC-60, manufactured by Shimadzu Corporation).

More specifically, the glass transition temperature (Tgr) of the polyester resin can be measured in accordance with the following procedure. Firstly, about 5.0 mg of the polyester resin is poured in an aluminum sample vessel, the sample vessel is put on a holder unit and then set in an electric furnace. Next, the sample vessel is heated from 20° C. to 150° C. at a temperature increasing rate of 10° C./min under a nitrogen atmosphere, then cooled from 150° C. to 0° C. at a temperature decreasing rate of 10° C./min, then further heated to 150° C. at a temperature increasing rate of 10° C./min, and a DSC curve is measured using a differential scanning calorimeter (DSC-60, manufactured by Shimadzu Corporation). From the obtained DSC curve, a shoulder at the second temperature increasing time is selected using an analysis program in the DSC-60 system, whereby a glass transition temperature (Tgr) of the polyester resin can be calculated.

Note that when two types of polyester resins are contained in the toner, at least one polyester resin is allowed to satisfy the glass transition temperature requirement described above.

The glass transition temperature (Tgr') of the polyester resin after addition of 10 parts by mass of the fixing-assisting component can also be measured in a similar manner as described above. Firstly, 0.5 mg of the fixing-assisting component and 4.5 mg of the polyester resin are poured in an aluminum sample vessel, the sample vessel is put on a holder unit and then set in an electric furnace. Next, the sample vessel is heated from 20° C. to 150° C. at a temperature increasing rate of 10° C./min under a nitrogen atmosphere, then cooled from 150° C. to 0° C. at a temperature decreasing rate of 10° C./min, then further heated to 150° C. at a temperature increasing rate of 10° C./min, and a DSC curve is measured using a differential scanning calorimeter (DSC-60, manufactured by Shimadzu Corporation). From the obtained DSC curve, a shoulder at the second temperature increasing time is selected using an analysis program in the DSC-60 system, whereby a glass transition temperature (Tgr') of the polyester resin after addition of the polyester resin can be calculated.

Note that when two types of polyester resins are contained in the toner, at least one polyester resin is allowed to satisfy the glass transition temperature requirement described above.

The amount of the fixing-assisting component contained in the toner is not particularly limited and may be suitably adjusted in accordance with the intended use, however, it is preferably 2% by mass to 25% by mass and more preferably 3% by mass to 20% by mass with respect to the total amount of the toner. When the amount is less than 2% by mass, the effect of the fixing-assisting component cannot be sufficiently obtained, possibly leading to degradation of the low-temperature fixability. When the amount is more than 25% by mass, the resulting toner may be inferior in the offset resistance and heat resistant storage stability.

<Binder Resin>

The binder resin contains a polyester resin for the reason that excellent low-temperature fixability can be obtained therefrom.

—Polyester Resin—

The polyester resin is not particularly limited, and the molecular weight thereof and monomer constituting the polyester resin may be suitably selected in accordance with the intended use.

The polyester resin can be obtained by dehydration condensation of a polyhydric alcohol and a polyvalent carboxylic acid.

Examples of the polyhydric alcohol include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a divalent alcohol obtained by addition of a cyclic ether, such as ethylene oxide and propylene oxide, to bisphenol A.

Note that in order for the polyester resin to be crosslinked, it is preferable to use a trivalent or higher polyvalent alcohol in combination, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy benzene.

Examples of the polyvalent carboxylic acid include benzene dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; unsaturated dibasic acids such as maleic acid, citraconic acid, itaconic acid, alkenylsuccinic acid, fumaric acid, and mesaconic acid; unsaturated dibasic acid anhydrides such as maleic anhydrides, citraconic anhydrides, itaconic anhydrides, and alkenylsuccinic anhydrides; trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxypropane, tetrakis(methylenecarboxy)methane, 1,2,7,8-octanetetracarboxylic acid, Empol trimer acid, anhydrides or partially lower alkyl esters thereof.

The acid value of the polyester resin is not particularly limited and may be suitably adjusted in accordance with the intended use, however, it is preferably 5 mgKOH/g to 40 mgKOH/g, and more preferably 10 mgKOH/g to 30 mgKOH/g. When the acid value is lower than 5 mgKOH/g, the affinity with paper as a main recording medium degrades. Thus, the low-temperature fixability of the toner may degrade, a negative chargeability is hardly obtained, and an image formed may degrade in quality. Also, when the acid value is lower than 5 mgKOH/g, the solubility of the fixing-assisting component with the fatty acid amide compound may be inferior, and so the toner may not obtain sufficient low-temperature fixability. In contrast, when the acid value is higher than 40 mgKOH/g, the toner is susceptible to environmental conditions such as high-temperature and high-humidity condition, and low-temperature and low-humidity conditions, which may lead to degradation of image quality.

Note that when two or more types of polyester resins are contained in the toner, at least one polyester resin is allowed to satisfy the glass transition temperature requirement described above.

The hydroxyl value of the polyester resin is not particularly limited and may be suitably selected in accordance with the intended use, however, it is preferably 5 mgKOH/g to 100 mgKOH/g, and more preferably 20 mgKOH/g to 60 mgKOH/g. When the hydroxyl value is lower than 5 mgKOH/g, the affinity with paper as a main recording medium degrades. Thus, the low-temperature fixability of the toner may degrade, a negative chargeability is hardly obtained, and an image formed may degrade in quality. Also, when the hydroxyl value is lower than 5 mgKOH/g, the solubility of the fixing-assisting component with the fatty acid amide compound may be inferior, and so the toner may not obtain sufficient low-temperature fixability. In contrast, when the hydroxyl value is higher than 100 mgKOH/g, the toner is susceptible to environmental conditions such as high-temperature and high-humidity condition, and low-temperature and low-humidity conditions, which may lead to degradation of image quality.

Note that when two or more types of polyester resins are contained in the toner, at least one polyester resin is allowed to satisfy the glass transition temperature requirement described above.

Also, from the view point of the fixability and offset resistance of the toner, the polyester resin preferably has at least one peak in the region of molecular weight of from 3,000 to 50,000 in a molecular weight distribution of components soluble in THF, and more preferably has at least one peak in the region of molecular weight of from 5,000 to 20,000 in the molecular weight distribution. Further, in the components of the polyester resin, which are soluble in THF, the amount of components having a molecular weight of 100,000 or less is preferably 60% by mass to 100% by mass.

Here, the molecular weight distribution of the polyester resin can be measured by, for example, gel permeation chromatography using THF as a solvent.

The glass transition temperature (Tg) of the polyester resin is preferably 55° C. to 80° C., and more preferably 60° C. to 75° C., from the viewpoint of the storage stability of the toner. When the Tg is within the range of 55° C. to 80° C., the toner will be excellent in storage stability in storage at a high temperature, and the softening effect of the fixing-assisting component can be exhibited to the binder resin, and so the resulting toner will be excellent in the low-temperature fixability.

The binder resin may further contain resins other than the polyester resin. Examples thereof include single polymers or copolymers of styrene monomer, acrylic monomer, methacrylic monomer and the like; polyol resins, phenol resins, silicone resins, polyurethane resins, polyamide resins, furan resins, epoxy resins, xylene resins, terpene resins, coumarone-eindene resins, polycarbonate resins, and petroleum resins. These resins other then the polyester resin may be used alone or in combination.

<Releasing Agent>

The releasing agent is not particularly limited and may be suitably selected in accordance with the intended use, however, a releasing agent having a low-melting point of 60° C. to 90° C. is preferable. A releasing agent having a low-melting point is dispersed along with the resin and effectively efficiently will act on an interface between a fixing roller and the resulting toner, and thus the toner will be excellent in hot offset resistance, even in oil-less process, i.e., without applying an oil-like releasing agent onto the fixing roller).

In particular, the toner of the present invention is superior in the low-temperature fixability because it contains the fixing-assisting component, and therefore it is expected that the temperature of the fixing roller can be set to a temperature lower than ever before. Thus, it is preferred that the releasing agent be capable of exhibiting its releasing property at lower temperatures. For this reason, a releasing agent having a melting point of 90° C. or lower is preferably employed. When the melting point of the releasing agent is lower than 60° C., the storage stability of the toner at high-temperatures may degrade, possibly leading to degradation in quality of a resulting image.

As the releasing agent, the following are, for example, exemplified.

Examples of releasing agents typified by waxes include natural waxes: vegetable waxes such as carnauba wax, cotton wax, Japan wax, and rice wax; animal waxes such as bees wax, and lanolin; mineral waxes such as ozokerite, cerecine; and petroleum waxes such as paraffin, microcrystalline, and petrolatum. Besides these natural waxes, there may be exemplified synthetic hydrocarbon waxes such as Fisher-Tropsh wax, polyethylene wax and polypropylene wax; and synthetic waxes such as ester wax, ketone wax, and ether wax. Further, the following may also be used: a fatty acid amide compound such as 12-hydroxy stearic acid amide, stearic acid amide, phthalic anhydride imide, and chlorinated hydrocarbon; a polyacrylate homopolymer or polyacrylate copolymer of low-molecular weight crystalline polymer resin, such as poly-n-stearyl methacrylate, and poly-n-lauryl methacrylate (e.g. a copolymer of n-stearyl acrylate-ethyl methacrylate, etc.); and a crystalline polymer having a long-chain alkyl group at its side chain, or the like. Among these, a hydrocarbon wax such as paraffin, polyethylene, and polypropylene are preferably used in terms that their solubility with the fixing-assisting component is low, they can independently work without impairing the mutual functions, and the low-temperature fixability of toner can be exhibited.

These releasing agents may be used alone or in combination.

The amount of the releasing agent contained in the toner is not particularly limited and may be suitably adjusted in accordance with the intended use. It is preferably 1% by mass to 30% by mass relative to the total amount of toner. When the amount of the releasing agent is less than 1% by mass, the offset resistance may degrade. When it is more than 30% by mass, the toner-filming resistance may degrade and image fogging may occur.

<Colorant>

The colorant may be suitably selected from among conventionally known dyes and pigments. Examples of the colorant include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, mineral fast yellow, nickel titan yellow, navel yellow, colcothar, red lead oxide, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue; Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, and lithopone.

These colorants may be used alone or in combination.

The amount of the colorant contained in the toner is not particularly limited and may be suitably adjusted in accordance with the intended use, however, it is preferably 1% by mass to 15% by mass, and more preferably 3% by mass to 10% by mass. When the amount of colorant is less than 1% by mass, the tinting strength of the colorant may degrade, and when it is more than 15% by mass, pigment dispersion failure may occur in the toner, which may lead to a decrease in the tinting strength and degradation of electric properties of the resulting toner.

The colorant may also be used as a masterbatch obtained by combining with a resin. Examples of such a resin include polyester, styrene or polymers of substitution product thereof, styrene copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic resin, rosin, modified rosin, terpene resin, aliphatic hydrocarbon resin, alicyclic hydrocarbon resin, aromatic resin, chlorinated paraffin, and paraffin wax.

These resins may be used alone or in combination.

Examples of the styrene or polymers of substitution product thereof include polystyrene, poly(p-chlorostyrene), and polyvinyltoluene.

Examples of the styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer.

The masterbatch can be obtained by mixing and kneading the resin for masterbatch and the colorant under application of high shear force. On that occasion, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

<Other Components>

As other components to be contained in the toner, for example, a charge controlling agent, inorganic fine particles, a cleanability improver, and a magnetic material.

Examples of the charge controlling agent include nigrosine dyes, chrome-containing metal complex dyes, molybdic acid chelate pigments, rhodamine dyes, alkoxy-based amines, quaternary ammonium salts (including fluorine-modified quaternary ammonium salt), alkylamides, single body of phosphorus or compound thereof, single body of tungsten or compound thereof, fluorochemical surfactants, salicylic acid metal salts, and metal salts of salicylic acid derivative.

As the charge controlling agent, commercially available products may be used. Specific examples of the commercially available charge controlling agents include BONTRON 03 of nigrosine dye, BONTRON P-51 of quaternary ammonium salt, BONTRON S-34 of metal-containing azo dye, E-82 of oxy naphthoatic acid-based metal complex, E-84 of salicylic acid-based metal complex, and E-89 of phenolic condensate (produced by ORIENT CHEMICAL); TP-302 and TP-415 of quaternary ammonium salt molybdenum complex (produced by HODOGAYA CHEMICAL); COPY CHARGE PSY VP2038 of quaternary ammonium salt, COPY BLUE PR of triphenyl methane derivative, COPY CHARGE NEG VP2036 of quaternary ammonium salt, COPY CHARGE NX, and VP434 (produced by Hoechst AG); LRA-901 and LR-147 of boron complex (produced by NIPPON CARLIT); copper phthalocyanine, perylene, quinacridone, and azo pigments; and other polymer compounds having a functional group such as sulfonic group, carboxyl group, quaternary ammonium salt or the like.

These charge controlling agents may be used alone or in combination.

The amount of the charge controlling agent contained in the toner is not particularly limited and may be suitably adjusted in accordance with the intended use, for example, it is preferably 0.1% by mass to 10% by mass and more preferably 0.2% by mass to 5% by mass relative to the amount of the binder resin. When the amount of the charge controlling agent is less than 0.1% by mass, the charge controlling property may not be sufficiently obtained, and when it is more than 10% by mass, the effect of the primary charge controlling agent is impaired due to excessively high chargeability of the toner to increase the electrostatic attraction force to a developing roller, possibly leading to degradation in flowability of the toner and degradation in image density.

The inorganic fine particles are used as an external additive for imparting flowability, developability and chargeability to the resulting toner. Examples of the inorganic fine particles include particles of silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

These inorganic fine particles may be used alone or in combination.

The primary particle diameter of the inorganic fine particles is preferably 5 nm to 2 μm, and more preferably 5 nm to 500 nm.

The amount of the inorganic fine particles in the toner is preferably 0.01% by mass to 5.0% by mass, and more preferably 0.01% by mass to 2.0% by mass, relative to the total amount of toner.

The inorganic fine particles are preferably surface-treated with a flowability improver. With this, the hydrophobicity of the inorganic fine particles is improved, and degradation of flowability and chargeability of the toner can be prevented even under high-humidity environments.

Examples of the flowability improver include silane coupling agents, silylation agents, silane coupling agents having a fluoride alkyl group, organic titanate-based coupling agents, aluminum-based coupling agents, silicone oils and modified silicone oils. Silica and titanium oxide are preferably surface-treated with a flowability improver to be used as a hydrophobic silica and a hydrophobic titanium oxide.

The cleanability improver is used for readily removing toner remaining on a photoconductor and/or a primary transfer medium after transfer of image.

Examples of the cleanability improver include fatty acid metal salts such as zinc stearic acid, and calcium stearate, and polymer fine particles produced by soap-free emulsification polymerization, such as polymethyl methacrylate fine particles, and polystyrene fine particles. The polymer fine particle preferably has a relatively narrow particle size distribution and a volume average particle diameter of 0.01 μm to 1 μm.

Examples of the magnetic material include iron powder, magnetite, and ferrite. The magnetic material is preferably in white, in terms of the color tone of toner.

The toner of the present invention is excellent in low-temperature fixability and offset resistance and is capable of forming a high-quality image over a long period of time. Therefore, the toner of the present invention can be used in a variety of fields, and it is preferably used especially in image formation by electrophotography.

<Method for Producing Toner>

The method for producing a toner is not particularly limited and may be suitably selected from among conventionally known toner production methods in accordance with the intended use. Examples of the toner production method include kneading-pulverization method, polymerization method, dissolution suspension method, and spray granulation method. Among these methods, dissolution suspension method and polymerization method where a toner is produced in an aqueous medium, are particularly preferable in terms that the fixing-assisting component and the polyester resin are easily formed in an insoluble state in the production of toner.

—Kneading-Pulverization Method—

In the kneading-pulverization method, for instance, toner materials including at least a binder resin, a colorant, a releasing agent and a fixing-assisting component are melt kneaded, the resulting product is subjected to pulverization and classification so as to produce toner base particles for the toner.

In the melt kneading, the toner materials are mixed, and the resulting mixture is charged into a melt-kneader so as to be melt-kneaded. As the melt-kneader, for example, a uniaxial- or biaxial-consecutive kneader or a batch-type kneader using a roll mill can be employed. For example, KTK type biaxial extruder manufactured by KOBE STEEL., LTD.; a TEM type biaxial extruder manufactured by TOSHIBA MACHINE CO., LTD.; a biaxial extruder manufactured by KCK; a PCM type biaxial extruder manufactured by IKEGAI, LTD.; and a co-kneader manufactured by BUSS are preferably used. It is preferred that these melt kneaders be used under appropriate conditions where no breakage of the molecular chains of the binder resin occurs. Specifically, the melt-kneading temperature is adjusted referring to the softening point of the binder resin. When the melt-kneading temperature is much higher than the softening point, extensive molecular chain breakage occurs. When the melt-kneading temperature is much lower than the softening point, it may result in poor dispersing.

In the pulverization, the kneaded product obtained in the kneading is pulverized. Specifically, in the pulverization, it is preferable that the obtained kneaded product be coarsely crushed and then finely pulverized. Preferred examples of the pulverizing method include a method in which a kneaded product is made collide with a collision plate in a jet stream, a method in which particles are made collided with each other, and a method in which a kneaded product is pulverized in a gap between a mechanically rotating roller and a stirrer.

In the classification, the pulverized product obtained in the pulverization is classified so that the particles have predetermined particle diameters. The classification can be effected by removing fine particles using, for example, a cyclone, a decanter, or a centrifugal separator.

When the pulverization and classification are completed, the pulverized product is classified by an airflow centrifugal force to produce toner base particles having predetermined particle diameters.

Subsequently, an external additive is added to the toner base particles. The toner base and the external additive are mixed and stirred using a mixer, whereby the external additive is pulverized so that surfaces of the toner base particles are coated with it. At this time, it is important that the external additive such as inorganic fine particles or resin fine particles be uniformly and firmly secured to the toner base particles in order to ensure durability.

—Polymerization Method—

In the toner production by a polymerization method, toner materials including, for example, at least a urea-bondable or urethane-bondable modified polyester resin, a colorant, a releasing agent and a fixing-assisting agent are dissolved and/or dispersed in an organic solvent. Then, the solution and/or dispersion is dispersed in an aqueous medium so as to be polyaddition-reacted, the solvent in the dispersion liquid is removed, and the resulting dispersion liquid is washed, thereby producing a toner.

As the urea- or urethane-bondable modified polyester resin, for example, a polyester prepolymer (A) having an isocyanate group, which is obtained by a reaction of a carboxyl group, hydroxyl group or the like at the end of a polyester with a polyisocyanate compound (PIC), is exemplified. A polyester resin that can be obtained by a reacting the polyester prepolymer with amines (B) or the like, so that molecular chains are crosslinked and/or elongated, can improve the hot offset resistance of the resulting toner while maintaining the low-temperature fixability.

Examples of the polyisocyanate compound (PIC) include aliphatic polyisocyanate (such as tetramethylene diisocyante, hexamethylene diisocyanate, and 2,6-diisocyanatomethylcaproate); alicyclic polyisocyanate (such as isophorone diisocyanate, and cyclohexylmethane diisocyante); aromatic diisocyanate (such as tolylene diisocyanate, and diphenylmethane diisocyanate); aromatic aliphatic diisocyanate (such as α,α,α',α'-tetramethylxylylene diisocyanate), isocyanates; and isocyanate compounds in which the above polyisocyanates are blocked with a phenol derivative, oxime, caprolactam or the like. These polyisocyanate compounds may be used alone or in combination.

The mixing ratio of the polyisocyanate compound (PIC), as an equivalent ratio [NCO]/[OH] of isocyanate group [NCO] content in the polyisocyanate to hydroxyl group [OH] content in a hydroxyl group-containing polyester prepolymer, is preferably 5/1 to 1/1, more preferably 4/1 to 1.2/1, and still more preferably 2.5/1 to 1.5/1.

The number of isocyanate groups per one molecule in the isocyanate group-containing prepolymer (A) is usually one or more, preferably 1.5 to 3 on average, and more preferably 1.8 to 2.5 on average.

Examples of the amines (B) to be reacted with the polyester prepolymer include a divalent amine compound (B1), a trivalent or higher polyvalent amine compound (B2), an amino alcohol (B3), an aminomercaptane (B4), an amino acid (B5), and a blocked amine (B6) which is blocked with any of the amino group of (B1) to (B5).

Examples of the divalent amine compound (B1) include aromatic diamine (such as phenylenediamine, diethyltoluenediamine, and 4,4'-diaminodiphenylmethane); alicyclic diamine (such as 4,4'-diamino-3,3'-dimethyldicyclohexylmethane, diaminecyclohexane, and isophoronediamine); and aliphatic diamine (such as ethylenediamine, and tetramethylenediamine).

Examples of the trivalent or higher polyvalent amine compound (B2) include diethylenetriamine, and triethylenetetramine.

Examples of the aminoalcohol (B3) include ethanolamine, and hydroxyethylaniline.

Examples of the aminomercaptane (B4) include aminoethylmercaptane, and aminopropylmercaptane.

Examples of the amino acid (B5) include aminopropionic acid, and aminocaproic acid.

Examples of the blocked amine (B6) which is blocked with any of the amino groups of (B1) to (B5) include ketimine compounds obtainable from the amines (B1) to (B5) and ketones (such as acetone, methylethylketone, and methylisobutylketone), and oxazolidine compounds. Among these amines (B), a divalent amine compound (B1), and a mixture of (B1) with a small amount of a trivalent or higher polyvalent amine compound (B2) are particularly preferable.

The mixing ratio of the amines (B), as an equivalent ratio of [NCO]/[NHx] of isocyanate group [NCO] content in the isocyanate group-containing polyester prepolymer (A) to amino group [NHx] content in the amines (B), is preferably 1/2 to 2/1, more preferably 1.5/1 to 1/1.5, and still more preferably 1.2/1 to 1/1.2.

According to the toner production by a polymerization method as described above, it is possible to produce a spherically shaped toner having a small particle diameter at low-production costs, without imposing environmental load.

(Developer)

The developer contains at least the toner of the present invention and further contains other suitably selected components, such as carrier. The developer may be a one-component developer composed of a toner or two-component developer composed of a toner and a carrier, however, when used in high-speed printers responding to recent enhancement in information processing speed, the two-component developer is preferable in terms of improvement of shelf-life. The developer can be widely used in a variety of known electrophotographic processes, such as magnetic one-component developing method, non-magnetic one-component developing method, two-component developing method.

When the toner is used for a one-component developer, the average particle diameter of the toner hardly varies therein, even when consumption and supply of toner particles are repeated. Further, the toner hardly forms an undesirable toner film on a developing roller or adheres to a blade configured to form a thin toner layer. Accordingly, the toner has consistent developability even after being agitated in a developing device.

When the toner is used for a two-component developer, the average particle diameter of the toner hardly varies therein, even when consumption and supply of toner particles are repeated. Accordingly, the toner has consistent developability even after being agitated in a developing device.

The developer of the present invention preferably includes a carrier in an amount of from 90% by mass to 98% by mass, and more preferably from 93% by mass to 97% by mass.

The carrier preferably includes a core and a resin layer covering the core, but is not limited thereto.

Specific preferred examples of usable materials for the core include, but are not limited to, manganese-strontium (Mn—Sr) and manganese-magnesium (Mn—Mg) materials having a magnetization of from 50 emu/g to 90 emu/g. These materials may be used alone or in combination. In terms of ensuring high image density, high-magnetization materials such as iron powders having a magnetization of 100 emu/g or more and magnetites having a magnetization of from 75 emu/g to 120 emu/g are preferably used. In order to produce high quality images, low-magnetization materials such as copper-zinc (Cu—Zn) materials having a magnetization of from 30 emu/g to 80 emu/g are preferably used, because a magnetic brush thereof may weakly contact a photoconductor.

The core preferably has a volume average particle diameter (D50) of from 10 μm to 150 μm, and more preferably from 20 μm to 80 μm. When the volume average particle diameter (D50) is less than 10 μm, the carrier excessively includes fine particles, thereby reducing magnetization per molecule. Consequently, carrier particles may scatter. When the volume average particle diameter (D50) is more than 150 μm, the carrier has a low specific area. Consequently, insufficiently-charged toner particles may scatter, or especially a solid image portion may not be reliably reproduced.

Specific preferred examples of usable resins for the resin layer include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and an acrylic monomer, copolymers of vinylidene fluoride and vinyl fluoride, fluoroterpolymers such as terpolymers of tetrafluoroethylene, vinylidene fluoride, and a non-fluorinated monomer, and silicone resins. These resins may be used alone or in combination.

Specific examples of the amino resins include, but are not limited to, urea-formamide resins, melamine resins, benzoguanamine resins, urea resins, polyamide resins, and epoxy resins.

Specific examples of the polyvinyl resins include, but are not limited to, acrylic resins, polymethyl methacrylate resins, polyacrylonitrile resins, polyvinyl acetate resins, polyvinyl alcohol resins, and polyvinyl butyral resins.

Specific examples of the polystyrene resins include, but are not limited to, polystyrene resins and styrene-acrylic copolymer resins.

Specific examples of the halogenated olefin resins include, but are not limited to, polyvinyl chloride.

Specific examples of the polyester resins include, but are not limited to, polyethylene terephthalate resins and polybutylene terephthalate resins.

The resin layer may include a conductive power, if desired. Specific examples of usable conductive powers include, but are not limited to, metal powders, carbon black, titanium oxide, tin oxide, and zinc oxide. The conductive power preferably has an average particle diameter of 1 μm or less. When the average particle diameter is larger than 1 μm, electric resistance thereof may be hardly controlled.

The resin layer can be formed by, for example, dissolving a silicone resin, etc., in an organic solvent to prepare a cover layer coating liquid, and evenly applying the cover layer coating liquid on the core by known methods such as a dip coating method, a spray coating method, and a brush coating method. The coated core is then subjected to drying and baking. Specific examples of the organic solvents include, but are not limited to, toluene, xylene, methylethylketone, methyl isobutyl ketone, and cellosolve butyl acetate. The baking method can be either or both of an external heating method or an internal heating method. Specific baking methods include methods using a fixed electric furnace, a portable electric furnace, a rotary electric furnace, a burner furnace, and a microwave, but are not limited thereto.

The amount of the resin layer in the carrier is preferably 0.01% by mass to 5.0% by mass relative to the total amount of the carrier. When the amount is less than 0.01% by mass, a uniform resin layer may not be formed on the surface of the core, and when it is more than 5.0% by mass, the resin layer becomes large in thickness, causing aggregation of carrier particles, which may result in incapability of producing uniform carrier particles.

The developer of the present invention can be preferably used in image formation by a variety of known electrophotographic processes, such as magnetic one-component developing method, non-magnetic one-component developing method, two-component developing method.

(Toner Container)

The toner container of the present invention houses the toner of the present invention therein. The container is not particularly limited and may be suitably selected from among known containers. For example, preferred examples are a container having a container main body and a cap.

The container is not limited in size, shape, structure, material, and the like. The container preferably has a cylindrical shape having spiral projections and depressions on the inner surface thereof. Such a container can feed the developer to an ejection opening by rotation. It is more preferable that a part or all of the spiral parts of such a container have a structure like an accordion. Suitable materials used for the container include materials having good dimensional accuracy. In particular, resins are preferably used. Specific preferred examples of usable resins for the container include, but are not limited to, polyester resins, polyethylene resins, polypropylene resins, polystyrene resins, polyvinylchloride resins, polyacrylic acids, polycarbonate resins, ABS resins, and polyacetal resins.

The container is preferably easily preservable, transportable, and handleable. Further, the container is preferably detachably mounted to a process cartridge and an image forming apparatus to feed the developer thereto.

(Image Forming Method and Image Forming Apparatus)

An image forming method according to the present invention preferably includes at least a latent electrostatic image forming step, a developing step, a transfer step, and a fixing step, more preferably further includes a cleaning step, and optionally includes a charge eliminating step, a recycling step, a controlling step, and the like, as necessary.

An image forming apparatus according to the present invention preferably includes a latent electrostatic image bearing member, a latent electrostatic image forming unit, a developing unit, a transfer unit and a fixing unit, more preferably further includes a cleaning unit, and optionally includes a charge eliminating unit, a recycling unit, a controlling unit, an the like, as necessary.

The image forming method of the present invention can be carried out by the image forming apparatus of the present invention. More specifically, the latent electrostatic image forming step can be carried out by the latent electrostatic image forming unit; the developing step can be carried out by the developing unit; the transfer step can be carried out by the transfer unit; the fixing step can be carried out by the fixing unit; and steps other than those described above can be carried out by the other units.

The latent electrostatic image forming step is a step of forming a latent electrostatic image on a latent electrostatic image bearing member such as a photoconductive insulator, a photoconductor and the like. The material, shape, structure, and size of the latent electrostatic image bearing member are not particularly limited and may be suitably selected from among any known image bearing members. A drum-shaped latent electrostatic image bearing member is preferably used. Specific examples of usable photoconductors include, but are not limited to, inorganic photoconductors including amorphous silicon, selenium, etc., and organic photoconductors including polysilane, phthalopolymethine, etc. Among these photoconductors, an amorphous silicon photoconductor is preferably used in terms of long life of the latent electrostatic image bearing member.

The latent electrostatic image forming unit forms a latent electrostatic image by uniformly charging a surface of the latent electrostatic image bearing member, and exposing imagewise the charged surface of the latent electrostatic image bearing member. The latent electrostatic image forming unit includes at least a charger to uniformly charge a surface of the latent electrostatic image bearing member and an exposing device to expose imagewise the charged surface of the latent electrostatic image bearing member.

As the charger, for example, any known contact chargers such as a conductive or semi-conductive roller, brush, film, and rubber blade, and any known non-contact chargers using corona discharge such as corotron and scorotron can be used.

The exposing device is not particularly limited, as long as it can expose imagewise the surface of the latent electrostatic image bearing member which has been charged by the charger. For example, various exposing devices using a radiation optical system, a rod lens array, a laser optical system, a liquid crystal shutter optical system are exemplified. In the present invention, the latent electrostatic image bearing member may be exposed with a light beam from the backside thereof.

In the developing step, the latent electrostatic image is developed with the developer of the present invention to form a visible image. The developing unit is not particularly limited as long as it can develop a latent electrostatic image with the toner of the present invention. For example, preferred is a developing unit containing the developer of the present invention, preferably contained in the above-described container, and capable of supplying the toner to the latent electrostatic image by either being in or out of contact therewith. The developing unit may employ a dry-developing process or wet-developing process, and may be either a monochrome or a multi-color developing unit. For example, a developing unit is exemplified, which is equipped with an agitator to agitate the developer of the present invention so as to triboelectrically charge and a rotatable magnetic roller. In the developing unit, for example, the toner and the carrier are mixed so that the toner is charged to form magnetic brushes on a surface of the rotatable magnetic roller. Since the magnetic roller is provided adjacent to the latent electrostatic image bearing member, a part of the toner that forms the magnetic brushes on the magnetic roller is moved to the surface of the latent electrostatic image bearing member due to an electric attraction force. As a result, the latent electrostatic image is developed with the toner and a toner image is formed on the surface of the latent electrostatic image bearing member. The developer housed in the developing unit is the developer of the present invention, but may also be a combination of both a one-component developer and a two-component developer.

In the transfer step, a toner image is transferred onto a recording medium. The transfer step is performed by, for example, charging a toner image formed on the latent electrostatic image bearing member by the transfer device such as a transfer charger. It is preferable that the transfer step includes a primary transfer step in which a toner image is transferred onto an intermediate transfer member and a secondary transfer step in which the toner image is transferred from the intermediate transfer member onto a recording medium. It is more preferable that the transfer step includes a primary transfer step in which two or more single-color toner images, preferably in full color, are transferred onto the intermediate transfer member to form a composite toner image and a secondary transfer step in which the composite toner image is transferred onto the recording medium.

The transfer unit preferably includes a primary transfer unit configured to transfer single-color toner images onto an intermediate transfer member to form a composite toner image and a secondary transfer unit to transfer the composite toner image onto a recording medium. Any known transfer members can be used as the intermediate transfer member. For example, an endless transfer belt is preferably used.

The transfer unit (such as the primary transfer unit and the secondary transfer unit) preferably includes a transferrer to separate the toner image from the latent electrostatic image bearing member toward the recording medium. The transfer unit optionally has at least one transferrer.

As the transferrer, a corona transferrer using corona discharge, a transfer belt, a transfer roller, a pressing transfer roller, an adhesion transferrer, etc., are exemplified.

The recording medium is not particularly limited and may be suitably selected from among, any known recording media, such as a recording paper.

In the fixing step, the toner image transferred onto a recording medium is fixed thereon by the fixing unit. When two or more single-color toners are used, each of single-color toner images may be independently fixed on the recording medium. Alternatively, a composite toner image in which single-color toner images are superimposed on one another may be fixed at once. As the fixing unit, any known heat and pressure applying devices are preferably used. As the heat and pressure applying device, there may be exemplified a combination of a heating roller and a pressurizing roller, a combination of a heating roller, a pressurizing roller, and an endless belt. A heating target is typically heated to a temperature of from 80° C. to 200° C. Any known optical fixing devices may be used alone or in combination with the above-described fixing device in the fixing step.

In the charge eliminating step, charges remaining on the latent electrostatic image bearing member are removed by applying a charge eliminating bias to the latent electrostatic image bearing member. The charge eliminating step is preferably performed by a charge eliminating unit. The charge eliminating unit is not particularly limited, as long as it is capable of applying a charge eliminating bias to the latent electrostatic image bearing member. For example, a charge eliminating lamp is preferably used.

In the cleaning step, toner particles remaining on the latent electrostatic image bearing member are removed by a cleaning unit. The cleaning unit is not particularly limited as long as it is capable of removing toner particles remaining on the latent electrostatic image bearing member. For example, a magnetic brush cleaner, an electrostatic brush cleaner, a magnetic roller cleaner, a blade cleaner, a brush cleaner, a web cleaner, etc. can be used.

In the recycle step, the toner particles removed in the cleaning step are recycled by a recycling unit. The recycling unit is not particularly limited, and any known conveyance units can be used.

In the control step, each of the steps is controlled by a controlling unit. The controlling unit is not particularly limited, as long as it can control the operations in each of the steps. For example, a sequencer, a computer, etc. can be used.

FIG. 1 is a schematic diagram illustrating an embodiment of an image forming apparatus according to the present invention. An image forming apparatus 100A includes a photoconductor drum 10 serving as a latent electrostatic image bearing member, a charging roller 20 serving as a charging unit, an exposing device 30 as an exposing unit, developing units 45 each serving as a developing unit, an intermediate transfer member 50, a cleaning device 60 having a cleaning blade serving as a cleaning unit, and a charge eliminating lamp 70 serving as a charge eliminating unit.

The intermediate transfer member 50 is an endless belt. The intermediate transfer member 50 is stretched taut by three rollers 51 to move endlessly in a direction indicated by an arrow in FIG. 1. Some of the rollers 51 have a function of applying a transfer bias to the intermediate transfer member 50 in the primary transfer process.

A cleaning device 90 including a cleaning blade is provided close to the intermediate transfer member 50. A transfer roller 80 serving as a transfer unit is provided facing the intermediate transfer member 50. The transfer roller 80 is capable of applying a transfer bias to transfer a toner image onto a recording paper 95 in the secondary transfer process.

A corona charger 52 configured to charge the toner image on the intermediate transfer member 50 is provided on a downstream side from a contact point of the intermediate transfer member 50 with the photoconductor drum 10, and a upstream side from a contact point of the intermediate transfer member 50 with the recording paper 95, relative to the direction of rotation of the intermediate transfer member 50.

The developing devices 45K, 45Y, 45M, and 45C include developer housing units 42K, 42Y, 42M, and 42C, developer feeding rollers 43K, 43Y, 43M, and 43C, and developing rollers 44K, 44Y, 44M, and 44C, respectively.

In the image forming apparatus 100A, the photoconductor drum 10 is evenly charged by the charging roller 20, and subsequently the exposing device 30, and the exposing device 30 exposes imagewise the photoconductor drum 10 with a light beam L to form an electrostatic latent image thereon. The electrostatic latent image formed on the photoconductor drum 10 is developed with toners supplied from the developing devices 45K, 45Y, 45M, and 45C to form a toner image. The toner image is then transferred onto the intermediate transfer member 50 due to a bias applied to some of the rollers 51 (i.e., the primary transfer process), and subsequently transferred onto the recording paper 95 (i.e., the secondary transfer process) by the corona charger 52. Toner particles remaining on the photoconductor drum 10 are removed by the cleaning device 60, and the photoconductor drum 10 is once decharged by the charge eliminating lamp 70.

Figure 2:
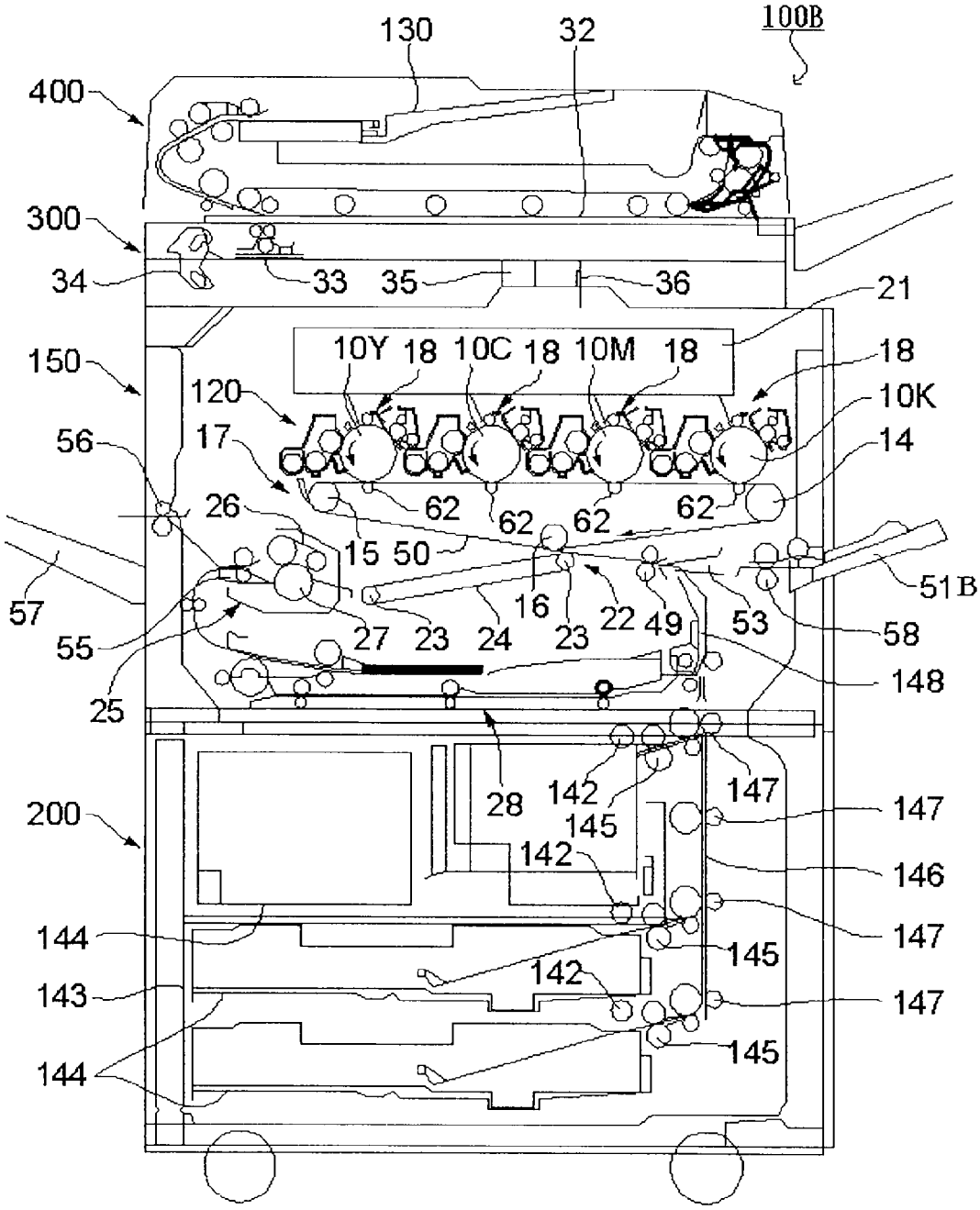
FIG. 2 is a diagram showing another example of an image forming apparatus according to the present invention.
Figure 3:
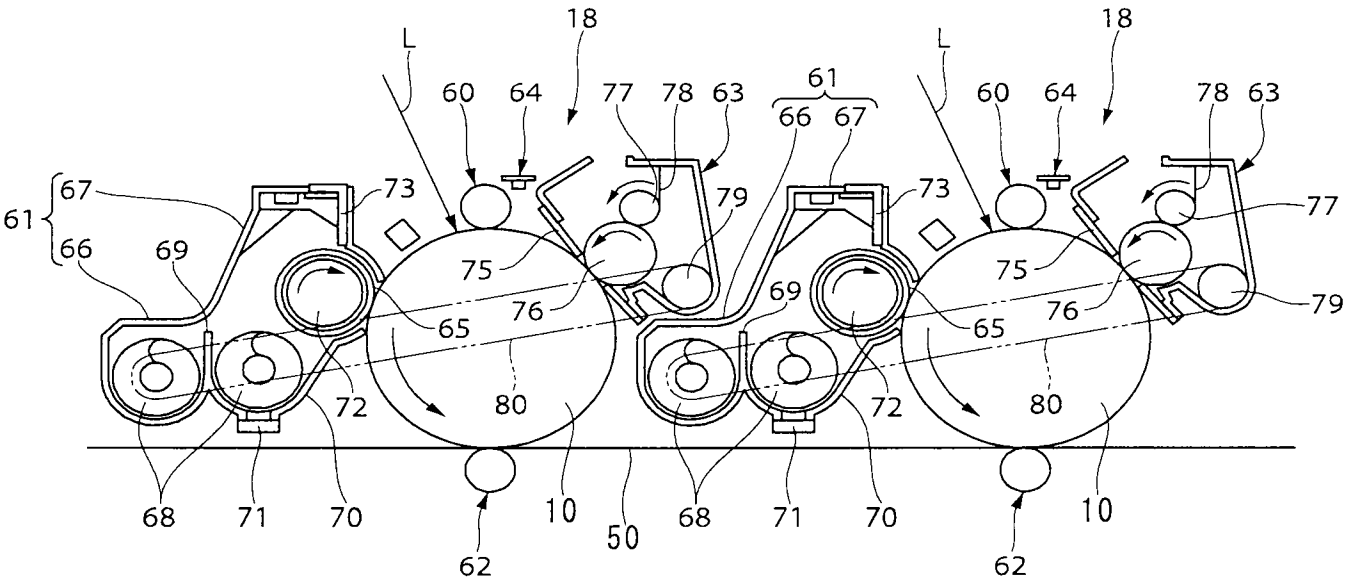
FIG. 3 is a diagram showing a tandem type developing device in the image forming apparatus shown in FIG. 2.

FIG. 2 is a schematic view illustrating another embodiment of an image forming apparatus according to the present invention. An image forming apparatus 100B is a tandem color image forming apparatus. The image forming apparatus 100B includes a main body 150, a paper feeding table 200, a scanner 300, and an automatic document feeder (ADF) 400.

An intermediate transfer member 50, which is an endless belt, is provided in a center of the main body 150. The intermediate transfer member 50 is stretched taut by support rollers 14, 15 and 16, and rotates in a clockwise direction.

A cleaning device 17, which is configured to remove residual toner particles remaining on the intermediate transfer member 50, is provided close to the support roller 15. A tandem-type image forming device 120 including four image forming units for individual four colors of yellow, cyan, magenta and black is provided facing the intermediate transfer member 50 so that the image forming units 18Y, 18C, 18M and 18K are arranged in this order around the intermediate transfer member 50 relative to the direction of rotation thereof.

The image forming units 18Y, 18C, 18M and 18K for the individual four colors are each provided with, as shown in FIG. 1, a photoconductor drum 10, a charging roller 20 configured to uniformly charge the photoconductor drum 10, a developing devices 45 each configured to develop a latent electrostatic image formed on the photoconductor drum 10 using individual color developers of black (K), yellow (Y), magenta (M) and cyan (C) to form each color toner image, a transfer roller 80 for transferring the each color toner image onto an intermediate transfer member 50, a cleaning device 60 and a charge eliminating lamp 70.

An exposing device 30 is provided close to the tandem-type image forming device 120. The exposing device 30 directs a light beam L onto the photoconductors 10Y, 10C, 10M, and 10K to respectively form electrostatic latent images thereon.

A secondary transfer device 22 is provided on the opposite side of the tandem-type image forming device 120 relative to the intermediate transfer member 50. The secondary transfer device 22 includes a secondary transfer belt 24, which is an endless belt, stretched taut by a pair of rollers 23. A sheet of a recording paper fed on the secondary transfer belt 24 contacts the intermediate transfer member 50.

A fixing device 25 is provided close to the secondary transfer device 22. The fixing device 25 includes a fixing belt 26 which is an endless belt, and a pressurizing roller 27 located so as to press the fixing belt 26.

A sheet-reversing device 28 configured to reverse a sheet of recording paper to form images on both sides thereof is provided close to the secondary transfer device 22 and the fixing device 25.

Next, a procedure for forming a full color image by the image forming apparatus 100B will be described. An original document is set to a document feeder 130 provided in the automatic document feeder (ADF) 400, or placed on a contact glass 32 provided in the scanner 300 by lifting up the automatic document feeder 400. When a start switch button (not shown) is pushed, the scanner 300 starts driving and a first carriage 33 and a second carriage 34 start moving. When the original document is set to the automatic document feeder 400, the scanner 300 starts driving after the original document is fed on the contact glass 32. When the original document is placed on the contact glass 32, the scanner 300 starts driving immediately after the start switch button is pushed. On that occasion, the original document is exposed with a light emitted by a light source via the first carriage 33, and the light reflected from the original document is then reflected by a mirror provided in the second carriage 34. The light passes through an imaging lens 35 and is received by a reading sensor 36. Thus, image information of individual colors of black, yellow, magenta and cyan is read.

The exposing device 30 exposes each of the photoconductors 10 (10Y, 10C, 10M, and 10K) with a light beam L containing image information corresponding to each color information to form an electrostatic latent image thereon. The electrostatic latent images thus formed are developed with the developers supplied from the developing devices 45 (45Y, 45C, 45M, and 45K to form yellow, cyan, magenta, and black toner images, respectively. These yellow, cyan, magenta, and black toner images formed on the photoconductor drums 10 (10Y, 10C, 10M, and 10K), respectively, are independently transferred onto the intermediate transfer member 50 in the primary transfer process and superimposed one another so that a composite toner image is formed the intermediate transfer member 50.

In the paper feeding table 200, a sheet of the recording paper is fed from one of multistage paper feeding cassettes 144, included in a paper bank 143, by selectively rotating one of paper feeding rollers 142. A sheet of the recording paper is separated by separation rollers 145 and fed to a paper feeding path 146. The sheet of the recording paper is fed to a paper feeding path 148, which is provided in the main body 150, by transport rollers 147, and is bumped against a registration roller 49 to stop. When a sheet of the recording paper is fed from a manual paper feeder 51B, the sheet is separated by a separation roller 58 to be fed to a manual paper feeding path 53, and is bumped against the registration roller 49 to stop. The registration roller 49 is typically grounded, however, a bias can be applied thereto in order to remove paper powder.

The sheet of the recording paper is fed to a space formed between the intermediate transfer member 50 and the secondary transfer device 22 by rotating the registration roller 49 in synchronization with an entry of the composite toner image formed on the intermediate transfer member 50. The composite toner image is transferred onto the sheet of the recording paper by the secondary transfer device 22 in the secondary transfer process.

The sheet of the recording paper having the composite toner image thereon is fed from the secondary transfer device 22 to the fixing device 25. The toner image is fixed on the sheet of the recording paper by application of heat and pressure from the fixing belt 26 and the pressurizing roller 27 in the fixing device 25. The sheet of the recording paper changes its direction by a switch blade 55, ejected by an ejection roller 56, and stacked on a paper ejection tray 57. When the sheet of the recording paper changes its direction by the switch blade 55 to be reversed in the sheet-reversing device 28, the sheet of the recording paper is fed to a transfer area again in order to form a toner image on the backside thereof. The sheet of the recording paper having a toner image on the back side thereof is ejected by the ejection roller 56 and stacked on the ejection tray 57.

Toner particles remaining on the intermediate transfer member 50 are removed by the cleaning device 17.

A process cartridge according to the present invention is detachably mounted to an electrophotographic image forming apparatus, and includes at least an electrostatic latent image bearing member to bear an electrostatic latent image and a developing device to develop an electrostatic latent image using the developer of the present invention to form a toner image, and may optionally include other members, if necessary.

The developing device is provided with the above-described container for housing the developer of the present invention and a developer bearing member to bear and transport the developer, and may optionally include a layer thickness-regulating member to regulate the thickness of the toner borne by the developer bearing member.

Figure 4:
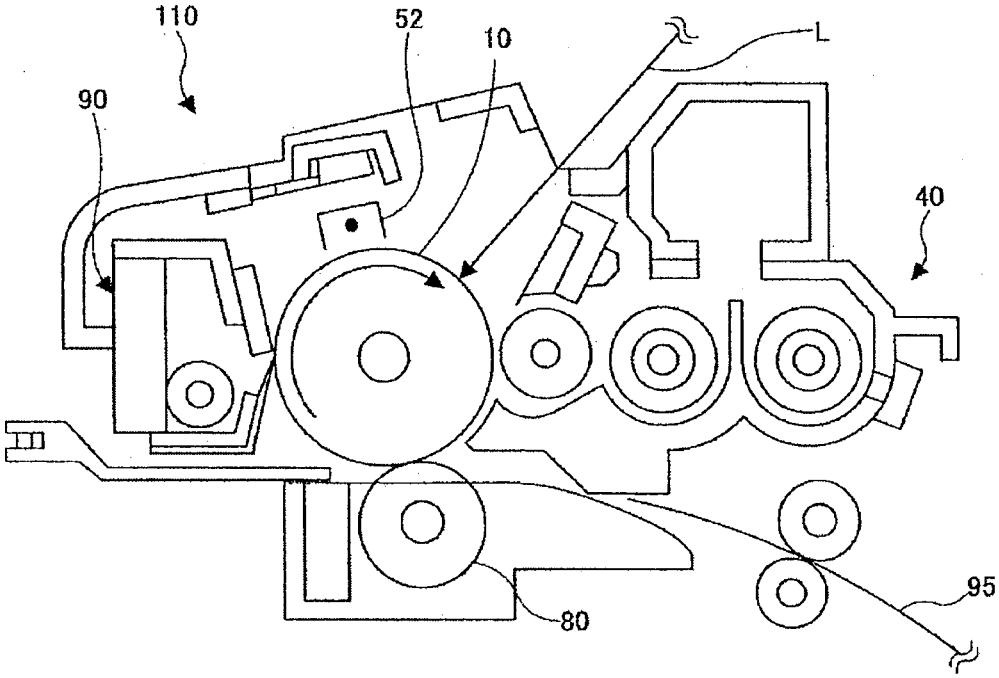
FIG. 4 is a diagram showing one example of a process cartridge according to the present invention.

FIG. 4 is a schematic diagram illustrating an embodiment of a process cartridge according to the present invention. A process cartridge 110 includes a photoconductor drum 10, a corona charger 52, a developing device 40, a transfer roller 80, and a cleaning device 90. In FIG. 4, a reference numeral 95 denotes a recording medium.

EXAMPLES

Hereinafter, Examples of the present invention will be described. However, these Examples should not be construed as limiting the present invention. As described above, the toner production method is not particularly limited. The following examples show the results obtained when toners were produced using a dissolution suspension method, which is one of methods of forming a toner in an aqueous medium. Note that in the description, "part" and "parts" mean "part by mass" and "parts by mass", respectively.

—Synthesis of Polyester Resin A—

Into a reaction vessel equipped with a condenser, a stirrer and a nitrogen inlet tube, 67 parts of ethylene oxide (2 mole) adduct of bisphenol A, 84 parts of propylene oxide (3 mole) adduct of bisphenol A, 274 parts of terephthalic acid, and 2 parts of dibutyltin oxide were charged. The mixture was reacted at 230° C. under normal pressure for 15 hours. Subsequently, the mixture was reacted under reduced pressure of from 5 mmHg to 10 mmHg for 8 hours to thereby synthesize a polyester resin. The polyester resin was found to have a number average molecular weight (Mn) of 2,300, a weight average molecular weight (Mw) of 8,000, a glass transition temperature (Tg) of 70° C., an acid value of 25 mgKOH/g, and a hydroxyl value of 35 mgKOH/g.

—Synthesis of Styrene-Acrylic Resin A—

Into a reaction vessel equipped with a condenser, a stirrer and a nitrogen inlet tube, 300 parts of ethyl acetate, 200 parts of styrene, 100 parts of acrylic monomer, and 5 parts of azobis-isobutylnitrile were charged, and the mixture was reacted at 65° C. (at normal pressure) under a nitrogen atmosphere for 10 hours. Subsequently, 200 parts of methanol were added to the mixture liquid, and the mixture liquid was stirred for 1 hour. A supernatant fluid was removed from the mixture liquid, and the mixture liquid was dried under reduced pressure to thereby synthesize a styrene-acrylic resin A. The styrene-acrylic resin A was found to have a weight average molecular weight (Mw) of 23,000 and a glass transition temperature (Tg) of 65° C.

—Synthesis of Esterified Compound—

As shown in Table 1, each of the fatty acids and each of the alcohol components were mixed at a predetermined molar ratio and charged along with a catalyst into a reaction vessel. The mixture was reacted by thermal esterification at 240° C. under a nitrogen gas stream to thereby synthesize esterified compounds (1) to (4) having the physical properties as shown in Table 1.

—Production of Masterbatch—

Water (1,000 parts), a carbon black having a DBP oil absorption of 42 mL/100 g and a pH value of 9.5 (PRINTEX35, produced by Degussa) (540 parts) and the polyester resin A (1,200 parts) were mixed in a HENSCHEL MIXER (manufactured by Mitsui Mining CO., LTD). Subsequently, the resulting mixture was kneaded with a two-roll at 150° C. for 30 minutes, cooled under pressure, and then pulverized by a pulverizer (manufactured by Hosokawa Micron K.K.) thereby producing a masterbatch.

—Preparation of Aqueous Medium—

Ion exchanged water (306 parts), a 10% by mass suspension liquid of tricalcium phosphate (265 parts) and dodecylbenzene sodium sulfonate (0.2 parts) were mixed and stirred so as to be uniformly dissolved to prepare an aqueous medium.

Example 1

<Production of Toner>

In a beaker, 80 parts of the polyester resin A, and 100 parts of ethyl acetate were charged and stirred so as to be dissolved. Subsequently, 5 parts of a stearic acid amide serving as a fixing-assisting component (NEUTRON-2, melting point: 95° C., produced by Nippon Fine Chemical K.K.), 1 part of stearic acid as a fatty acid constituting the fixing-assisting component (NAA180, melting point: 67° C., produced by NOF CORPORATION), 5 parts of a paraffin wax serving as a releasing agent (HNP-11, melting point: 69° C., produced by Nippon Seiro Co., Ltd.), and 10 parts of the masterbatch were charged to the solution. The solution was pulverized in three passes using a beads mill (ULTRA VISCO MILL, manufactured by Aymex Co.) at a liquid feeding rate of 1 kg/hr, a disc circumferential speed of 6 m/sec, and filling a zirconia bead having a particle size of 0.5 mm at 80% by volume, thereby preparing a toner material liquid.

In a vessel, 150 parts of the aqueous medium was poured and while the aqueous medium being stirred at 12,000 rpm using a TK homomixer (manufactured by PRIMIX Corporation), 100 parts of the toner material liquid were poured thereto and mixed for 10 minutes to prepare an emulsion slurry.

In a Kolben equipped with a stirrer and a thermometer, 100 parts of the emulsion slurry were charged, and desolvented at 30° C. for 12 hours while stirring at a circumferential speed of 20 m/min to thereby obtain a dispersion slurry.

TABLE 1

| | Composition ratio of fatty acid (mass ratio) | | | | Composition ratio of alcohol component (mass ratio) | | Molar ratio | | Melting |
|---|---|---|---|---|---|---|---|---|---|
| Table 1 | Stearic acid | Behenic acid | Lauric acid | Palmitic acid | Ethylene glycol | Glycerin | (fatty acid:alcohol) | Hydroxyl value | point (° C.) |
| Esterified compound (1) | 50 | 50 | 0 | 0 | 100 | 0 | 0.8:1.0 | 40 | 72 |
| Esterified compound (2) | 100 | 0 | 0 | 0 | 0 | 100 | 0.7:1.0 | 50 | 63 |
| Esterified compound (3) | 100 | 0 | 0 | 0 | 100 | 0 | 1.0:1.0 | 5 | 78 |
| Esterified compound (4) | 50 | 50 | 0 | 0 | 100 | 0 | 0.4:1.0 | 110 | 61 |

Next, 100 parts of the dispersion slurry was filtered under reduced pressure to obtain a wet cake. To the wet cake thus obtained, 100 parts of ion exchanged water were added and mixed using a TK homomixer at 12,000 rpm for 10 minutes, followed by filtration. To the resulting wet cake, 300 parts of ion exchanged water were added and mixed using the TK homomixer at 12,000 rpm for 10 minutes, followed by filtration. This operation was performed three times. To the resulting filter cake, 10 parts of a 10% aqueous solution of hydrochloric acid were added, and mixed using the TK homomixer at 12,000 rpm for 10 minutes, followed by filtration. Further, to the resulting filter cake, 300 parts of ion exchanged water were added and mixed using the TK homomixer at 12,000 rpm for 10 minutes, followed by filtration. This operation was performed twice to obtain a filter cake.

Next, the resulting filter cake was dried at 45° C. for 48 hours using a circulating air drier, followed by sieving with a screen having openings of 75 μm. Thus, mother toner particles were prepared.

Next, 100 parts of the mother toner particles and 1.0 part of a hydrophobized silica (H2000, produced by Clariant Japan K.K.) were mixed using a HENSCHEL MIXER (manufactured by Mitsui Mining Co., Ltd.) at a circumferential speed of 30 m/sec for 30 seconds, followed by pause for 1 minute. This mixing operation was repeated for 5 times. Then, the mixture was sieved with a screen having openings of 35 μm, thereby producing a toner of Example 1.

Example 2

A toner of Example 2 was produced in a similar manner to that described in Example 1, except that the esterified compound (1) (ethylene glycol sesquibehenate/stearate, hydroxyl value: 40 mgKOH/g, melting point: 72° C.) was used instead of the stearic acid amide serving as a fixing-assisting component.

Example 3

A toner of Example 3 was produced in a similar manner to that described in Example 1, except that the esterified compound (2) (glycerin distearate, hydroxyl value: 50 mgKOH/g, melting point: 63° C.) was used instead of the stearic acid amide serving as a fixing-assisting component.

Example 4

A toner of Example 4 was produced in a similar manner to that described in Example 2, except that a behenic acid (NAA222, melting point: 75° C., produced by NOF CORPORATION) was used instead of the stearic acid as a fatty acid constituting the fixing-assisting component.

Example 5

A toner of Example 5 was produced in a similar manner to that described in Example 1, except that the amount of the stearic acid as a fatty acid constituting the fixing-assisting component was changed from 1 part by mass to 4.5 parts by mass.

Example 6

A toner of Example 6 was produced in a similar manner to that described in Example 1, except that the amount of the stearic acid as a fatty acid constituting the fixing-assisting component was changed from 1 part by mass to 5.5 parts by mass.

Example 7

A toner of Example 7 was produced in a similar manner to that described in Example 1, except that the amount of the stearic acid as a fatty acid constituting the fixing-assisting component was changed from 1 part by mass to 0.3 parts by mass.

Example 8

A toner of Example 8 was produced in a similar manner to that described in Example 1, except that the amount of the stearic acid amide serving as a fixing-assisting component was changed from 5 parts by mass to 3 parts by mass.

Example 9

A toner of Example 9 was produced in a similar manner to that described in Example 1, except that the amount of the stearic acid amide serving as a fixing-assisting component was changed from 5 parts by mass to 2 parts by mass.

Example 10

A toner of Example 10 was produced in a similar manner to that described in Example 1, except that the amount of the stearic acid amide serving as a fixing-assisting component was changed from 5 parts by mass to 20 parts by mass.

Example 11

A toner of Example 11 was produced in a similar manner to that described in Example 1, except that the amount of the stearic acid amide serving as a fixing-assisting component was changed from 5 parts by mass to 25 parts by mass.

Example 12

A toner of Example 12 was produced in a similar manner to that described in Example 1, except that the esterified compound (3) (ethylene glycol distearate, hydroxyl value: 5 mgKOH/g, melting point: 78° C.) was used instead of the stearic acid amide serving as a fixing-assisting component.

Example 13

A toner of Example 13 was produced in a similar manner to that described in Example 1, except that the esterified compound (4) (ethylene glycol sesquibehenate/stearate, hydroxyl value: 110 mgKOH/g, melting point: 61° C.) was used instead of the stearic acid amide serving as a fixing-assisting component.

Example 14

A toner of Example 14 was produced in a similar manner to that described in Example 1, except that a stearyl stearic acid amide (NIKKAMIDE S, melting point: 95° C., produced by Nippon Kasei Chemical Co., Ltd.) was used instead of the stearic acid amide serving as a fixing-assisting component.

Comparative Example 1

A toner of Comparative Example 1 was produced in a similar manner to that described in Example 1, except that the stearic acid amide serving as a fixing-assisting component was not added.

Comparative Example 2

A toner of Comparative Example 2 was produced in a similar manner to that described in Example 1, except that the stearic acid serving as a fatty acid constituting the fixing-assisting component was not added.

Comparative Example 3

A toner of Comparative Example 3 was produced in a similar manner to that described in Example 1, except that the stearic acid serving as a fatty acid constituting the fixing-assisting component was not added, and 1 part by mass of lauric acid was added.

Comparative Example 4

A toner of Comparative Example 4 was produced in a similar manner to that described in Example 1, except that the styrene acrylic resin A was used instead of the polyester resin A.

With the procedures described above, toners of Examples 1 to 14 and Comparative Examples 1 to 4 were produced. Table 2 shows the types of binder resins, fixing-assisting components, and fatty acids used in the resulting individual toners, and each molar ratio between the fixing-assisting component and the fatty acid in each of the toners.

TABLE 2

| | Binder resin | Fixing-assisting component | Fatty acid |
|---|---|---|---|
| Example 1 | Polyester resin A | Stearic acid amide 5 parts | Stearic acid 1 part |
| Example 2 | Polyester resin A | Esterified compound (1) 5 parts | Stearic acid 1 part |
| Example 3 | Polyester resin A | Esterified compound (2) 5 parts | Stearic acid 1 part |
| Example 4 | Polyester resin A | Esterified compound (1) 5 parts | Behenic acid 1 part |
| Example 5 | Polyester resin A | Stearic amide 5 parts | Stearic acid 4.5 parts |
| Example 6 | Polyester resin A | Stearic amide 5 parts | Stearic acid 5.5 parts |
| Example 7 | Polyester resin A | Stearic amide 5 parts | Stearic acid 0.3 parts |
| Example 8 | Polyester resin A | Stearic amide 3 parts | Stearic acid 1 part |
| Example 9 | Polyester resin A | Stearic amide 2 parts | Stearic acid 1 part |
| Example 10 | Polyester resin A | Stearic amide 20 parts | Stearic acid 1 part |
| Example 11 | Polyester resin A | Stearic amide 25 parts | Stearic acid 1 part |
| Example 12 | Polyester resin A | Esterified compound (3) 5 parts | Stearic acid 1 part |
| Example 13 | Polyester resin A | Esterified compound (4) 5 parts | Stearic acid 1 part |
| Example 14 | Polyester resin A | Steary stearic acid amide 5 parts | Stearic acid 1 part |
| Comparative Example 1 | Polyester resin A | | Stearic acid 1 part |
| Comparative Example 2 | Polyester resin A | Stearic amide 5 parts | |
| Comparative Example 3 | Polyester resin A | Stearic amide 5 parts | Lauric acid 1 part |
| Comparative Example 4 | Styrene acrylic resin A | Stearic amide 5 parts | Stearic acid 1 part |

<Preparation of Carrier>

In 100 parts of toluene, 100 parts of a silicone resin (organo straight silicone), 5 parts of γ-(2-aminoethyl)aminopropyl trimethoxy silane, and 10 parts of a carbon black were added and dispersed using a homomixer for 20 minutes to prepare a resin layer coating liquid. The resin layer coating liquid was applied on surfaces of 1,000 parts of spherically shaped magnetite particles having an average particle diameter of 50 μm, and thus a carrier was prepared.

<Production of Developer>

Five parts of each of the produced toners and 95 parts of the carrier were mixed using a ball mill to thereby produce a developer.

<Evaluation Method and Evaluation Result>

Each of the produced developers was evaluated as follows. The evaluation results are shown in Table 3.

—Minimum Fixing Temperature—

Each of the developers and a paper TYPE 6200 (produced by Ricoh Company Ltd.) were set in a copier MF-200 (produced by Ricoh Company Ltd.) employing a fixing roller using TEFLON (registered trademark), in which the fixing unit was modified. Images were formed by changing the temperature of the fixing roller in decrement of 5° C. to determine a minimum fixable temperature. The minimum fixable temperature was defined as a minimum temperature at which the residual rate of image density after rubbing the fixed image with a pad was 70% or more. Preferably, the minimum fixable temperature is as low as possible, because of consuming lower amounts of power. A toner having a minimum fixable temperature of 135° C. or less has no problem in practical use.

—Hot Offset Temperature—

A tandem color electrophotographic apparatus IMAGIO NEO C350 (manufactured by Ricoh Company Ltd.) was modified such that a silicone oil applying mechanism was removed, a fixing unit was modified into an oilless fixing unit, and the temperature and linear velocity thereof are controllable. Each of the developers was set in the tandem color electrophotographic apparatus thus modified, and the tandem color electrophotographic apparatus was adjusted so as to form a toner image with a toner at 0.85 mg/cm$^2$±0.3 mg/cm$^2$. The toner images were fixed by changing the temperature of the fixing roller in increments of 5° C., so that a temperature at and above which hot offset occurred (hereinafter "hot offset temperature") was determined. The hot offset temperature was defined as a maximum temperature of the fixing roller at which the formed image could be fixed without causing hot offset. Preferably, the hot offset temperature is as high as possible. A toner having a hot offset temperature of 190° C. or more has no problem in practical use.

—Transfer Rate—

Each of the developers was set in an image forming apparatus MF2800 (manufactured by Ricoh Company Ltd.), and a black solid image having an image area of 15 cm×15 cm and an image density of 1.38 or more, measured by a Macbeth reflective densitometer, was formed. The transfer rate is calculated from the following Equation (1):

$$\text{Transfer Rate [\%]} = (\text{Amount of toner transferred onto a recording medium/Amount of toner developed on a photoconductor}) \times 100 \quad \text{Equation (1)}$$

The transfer rate was graded into the following 4 levels:

A: 90% or higher

B: 80% or higher and lower than 90%

C: 70% or higher and lower than 80%

D: lower than 70%

—Transfer Nonuniformity—

Each of the developers was set in an image forming apparatus MF2800 (manufactured by Ricoh Company Ltd.), and a black solid image was formed. The formed black solid image was visually observed whether or not toner particles are unevenly transferred, and evaluated as follows:

A: No transfer nonuniformity was observed, and was on a favorable level.

B: No transfer nonuniformity was observed, and no problem in practical use.

C: Transfer nonuniformity was slightly observed, but no problem in practical use.

D: Transfer nonuniformity was observed, and not suitable for practical use.

—Fogging—

Each of the developers was set in a tandem color electrophotographic apparatus IMAGIO NEO 450 (manufactured by Ricoh Company Ltd.) employing a cleaning blade and a charging roller each being in contact with a photoconductor, and 10,000 sheets of an image pattern A were formed. The image pattern A is a lateral A4-size chart in which black solid images and white solid images are alternately arranged at intervals of 1 cm in a direction vertical to a direction of rotation of a developing sleeve. Subsequently, a white solid image was output and visually observed whether or not fogging was caused.

A: No fogging was observed.

B: Fogging was observed.

—Toner Filming—

Each of the developers was set in an image forming apparatus MF2800 (manufactured by Ricoh Company Ltd.) and 10,000 sheets of an image were formed. Thereafter, the photoconductor was visually observed whether or not toner components such as a releasing agent adhered thereto, and evaluated as follows:

A: No toner component adhered to the photoconductor.

B: Toner components were adhered to the photoconductor, but no problem in practical use.

C: Toner components were adhered to the photoconductor, and not suitable for practical use.

—Heat Resistant Storage Stability—

In evaluation of heat resistant storage stability, each of the toners was used.

A 50-mL glass container was filled with each of the above-prepared toners. The glass container containing the toner was set in a constant-temperature chamber of 50° C. for 24 hours, and subsequently cooled to 24° C. The toner was subjected to a penetration test according to JIS K2235-1991. Heat resistant storage stability of each of the toners was evaluated by the penetration as follows:

A: The penetration was 25 mm or more.

B: The penetration was 15 mm or more and less than 25 mm.

C: The penetration was 5 mm or more and less than 15 mm.

D: The penetration was less than 5 mm.

The greater the penetration, the better the heat resistant storage stability is. Therefore, when the penetration is less than 5 mm, a problem may highly occur in practical use.

TABLE 3

| | Fixability | | Transferability | | Heat resistant | | |
|---|---|---|---|---|---|---|---|
| | Minimum fixable temperature | Hot offset temperature | Transfer rate | Transfer nonuniformity | storage stability | Fogging | Toner filming |
| Example 1 | 110° C. | 200° C. | A | A | B | A | A |
| Example 2 | 110° C. | 200° C. | A | A | B | A | A |
| Example 3 | 115° C. | 195° C. | A | A | B | A | A |
| Example 4 | 115° C. | 200° C. | A | A | A | A | A |
| Example 5 | 110° C. | 200° C. | A | A | B | A | A |
| Example 6 | 110° C. | 200° C. | A | A | C | A | A |
| Example 7 | 110° C. | 200° C. | B | B | B | A | A |
| Example 8 | 115° C. | 200° C. | A | A | B | A | A |
| Example 9 | 120° C. | 200° C. | A | A | B | A | A |
| Example 10 | 110° C. | 200° C. | B | B | B | A | A |
| Example 11 | 110° C. | 200° C. | B | B | C | A | B |
| Example 12 | 120° C. | 190° C. | A | A | B | A | A |
| Example 13 | 120° C. | 200° C. | A | A | B | A | A |
| Example 14 | 115° C. | 200° C. | B | B | C | A | B |
| Comparative Example 1 | 135° C. | 185° C. | B | B | B | A | A |
| Comparative Example 2 | 125° C. | 190° C. | C | C | B | B | C |
| Comparative Example 3 | 125° C. | 185° C. | C | C | C | A | B |
| Comparative Example 4 | 135° C. | 185° C. | B | B | C | B | A |

The results shown in Table 3 demonstrate that the toners of Examples 1 to 14 are excellent in low-temperature fixability and hot offset resistance because these toners contain a polyester resin superior in low-temperature fixability, an esterified compound or an amide compound each serving as a fixing-assisting component and being excellent in solubility with the polyester resin, and a fatty acid constituting the fixing-assisting component. Further, the fixing-assisting component has been uniformly dispersed for each toner particle in the resulting toner by effect of the fatty acid constituting the fixing-assisting component. Accordingly, the resulting toner has superior transferability and is capable of forming a high-quality image over a long period of time, without causing image fogging and toner filming.

The toner of Comparative Example 1 was found to be inferior in low-temperature fixability because the fixing-assisting component was removed from the toner of Example 1.

The toner of Comparative Example 2 was found to be inferior in hot offset resistance and transferability, and also found to be incapable of suppressing occurrence of image fogging and toner filming because the toner was produced so as not to contain a fatty acid constituting the fixing-assisting component.

The toner of Comparative Example 3 was found to be inferior in transferability and heat resistant storage stability, and also found to be incapable of suppressing occurrence of toner filming because the toner was produced so as to contain a fatty acid different from the component constituting the fixing-assisting component.

The toner of Comparative Example 4 was found to be inferior in low-temperature fixability and incapable of suppressing occurrence of image fogging.

The results described above show that the toners of Examples 1 to 14 have excellent low-temperature fixability and hot offset resistance, and hardly contaminate a fixing device or the resultant image, and high quality toner images can be formed therewith over a long period of time.

What is claimed is:

1. A toner comprising:

a polyester resin as a binder resin, a colorant in an amount of 1% to 15% by mass based on total amount of toner, a fixing-assisting component in an amount of 2% to 25% by mass based on total amount of toner, a fatty acid in an amount of 0.5% to 5% by mass based on total amount of toner, and a releasing agent in addition to the fixing-assisting component and the fatty acid, wherein the releasing agent is present in an amount of 1% to 30% by mass based on total amount of toner, wherein the releasing agent is any one of carnauba wax, cotton wax, Japan wax, rice wax, bees wax, lanolin, ozokerite, cerecine, paraffin wax, microcrystalline wax, petrolatum, Fisher-Tropsh wax, polyethylene wax, polypropylene wax, ketone wax, ether wax, poly-n-stearyl methacrylate, poly-n-lauryl methacrylate, a copolymer of n-stearyl acrylate-ethyl methacrylate, and a crystalline polymer having a long-chain alkyl group at its side chain;

wherein the fixing-assisting component has a melting point of 60° C. to 120° C. and comprises at least is any one of an esterified compound obtained by esterification of the fatty acid and an amide compound obtained by amidation of the fatty acid.

2. The toner according to claim 1, wherein the amide compound has a melting point of 70° C. to 120° C. and is a fatty acid amide compound having one of an amino group and a hydroxyl group at the end of its molecular chain.

3. The toner according to claim 1, wherein the esterified compound is obtained by reaction of a fatty acid containing at least one of a stearic acid and a behenic acid in an amount of 80% by mass or more, with an alcohol containing ethylene glycol in an amount of 80% by mass or more; and the esterified compound has a hydroxyl value of 10 mgKOH/g to 100 mgKOH/g, and a melting point of 60° C. to 85° C.

4. The toner according to claim 1, wherein the amount of the fixing-assisting component contained in the toner is 3% by mass to 20% by mass relative to the total amount of the toner.

5. The toner according to claim 1, wherein at least one polyester resin has an acid value of 5 mgKOH/g to 40 mgKOH/g.

6. The toner according to claim 1, wherein at least one polyester resin has a hydroxyl value of 5 mgKOH/g to 100 mgKOH/g.

7. The toner according to claim 1, wherein at least one polyester resin has a glass transition temperature Tg of 55° C. to 80° C.

8. The toner according to claim 1, produced in an aqueous medium.

9. A developer comprising:

a toner, wherein the toner comprises at least a polyester resin as a binder resin, a colorant in an amount of 1% to 15% by mass based on total amount of toner, a fixing-assisting component in an amount of 2% to 25% by mass based on total amount of toner, a fatty acid in an amount of 0.5% to 5% by mass based on total amount of toner, and a releasing agent in addition to the fixing-assisting compound and the fatty acid, wherein the releasing agent is present in an amount of 1% to 30% by mass based on total amount of toner, wherein the releasing agent is any one of carnauba wax, cotton wax, Japan wax, rice wax, bees wax, lanolin, ozokerite, cerecine, paraffin wax, microcrystalline wax, petrolatum, Fisher-Tropsh wax, polyethylene wax, polypropylene wax, ketone wax, ether wax, poly-n-stearyl methacrylate, poly-n-lauryl methacrylate, a copolymer of n-stearyl acrylate-ethyl methacrylate, and a crystalline polymer having a long-chain alkyl group at its side chain, and wherein the fixing-assisting component has a melting point of 60° C. to 120° C. and is any one of an esterified compound obtained by esterification of the fatty acid and an amide compound obtained by amidation of the fatty acid.

10. An image forming method comprising:

forming a latent electrostatic image on a surface of a latent electrostatic image bearing member, developing the latent electrostatic image using a toner to form a visible image, transferring the visible image onto a recording medium, and fixing the transferred image on the recording medium, wherein the toner is the toner as claimed in claim 1.

* * * * *